US005637818A

United States Patent [19]

Fishman et al.

[11] Patent Number: 5,637,818

[45] Date of Patent: Jun. 10, 1997

[54] VIBRATO FOR A STRINGED MUSICAL INSTRUMENT

[76] Inventors: Larry Fishman, 22 Calumet Rd., Winchester, Mass. 01887; Kenneth Parker, 12 Old Town Rd., Seymour, Conn. 06483

[21] Appl. No.: 369,550

[22] Filed: Jan. 6, 1995

Related U.S. Application Data

[63] Continuation-in-part of Ser. No. 275,157, Jul. 14, 1994, which is a continuation-in-part of Ser. No. 862,975, Apr. 3, 1992, Pat. No. 5,337,644, which is a division of Ser. No. 352,154, May 15, 1989, Pat. No. 5,125,312.

[51] Int. Cl.[6] ..... G10D 3/00; G10D 1/08

[52] U.S. Cl. ..... 84/313; 84/267

[58] Field of Search ..... 84/313, 298, 307, 84/308, 309, 267, 268

[56] References Cited

U.S. PATENT DOCUMENTS 4,882,967 11/1989 Rose ..... 84/313
4,941,384 7/1990 Jager ..... 84/313
5,260,511 11/1993 Gregory ..... 84/313

*Primary Examiner*—Cassandra C. Spyrou
*Attorney, Agent, or Firm*—Wolf, Greenfield & Sacks, P.C.

[57] ABSTRACT

A stringed instrument, such as a guitar, has a vibrato that includes a bridge rotatably mounted within a body of the instrument. A flat compression spring extends from the bridge to a position away from a neck of the instrument. At the other end, the spring abuts a support that is linearly movable relatrive to the bridge to increase or decrease the compression force of the spring. A step stop is positioned near the bridge to allow a user to selectively move the bridge between a floating mode in which it can rotate in either direction from a neutral position to a classic mode in which it can move in one direction. The compression can be adjusted so that the bridge is effectively stopped from moving in a direction opposite to the particular direction. The bridge is moved with a control bar that extends into a rotatable bushing. The frictional forces between the bushing and the bridge can be adjusted with a set screw. The bar has a generally hexagonal cross section and is bowed within the bushing so that it can be easily removed and reinserted if desired.

16 Claims, 19 Drawing Sheets

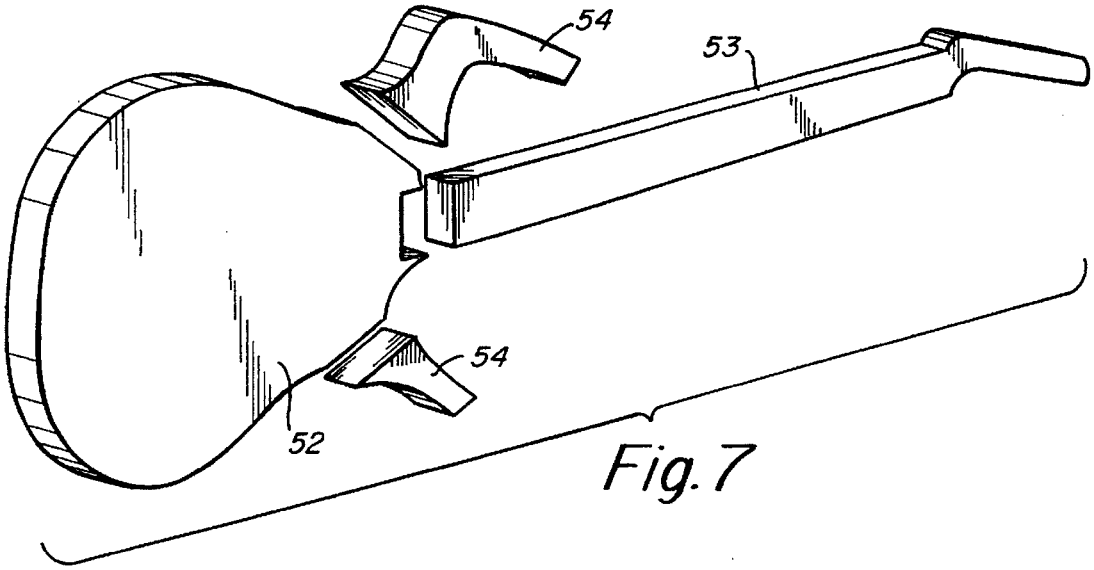
Fig. 7
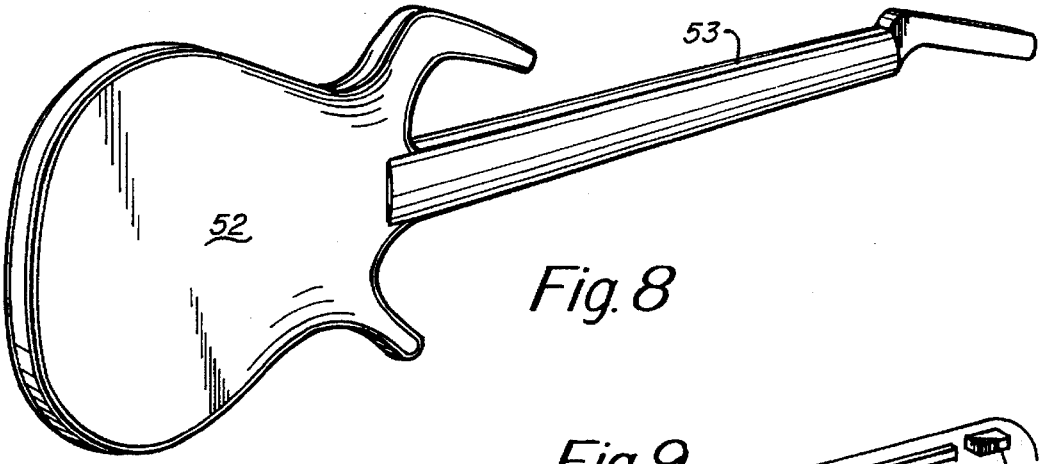
Fig. 8
Fig. 9
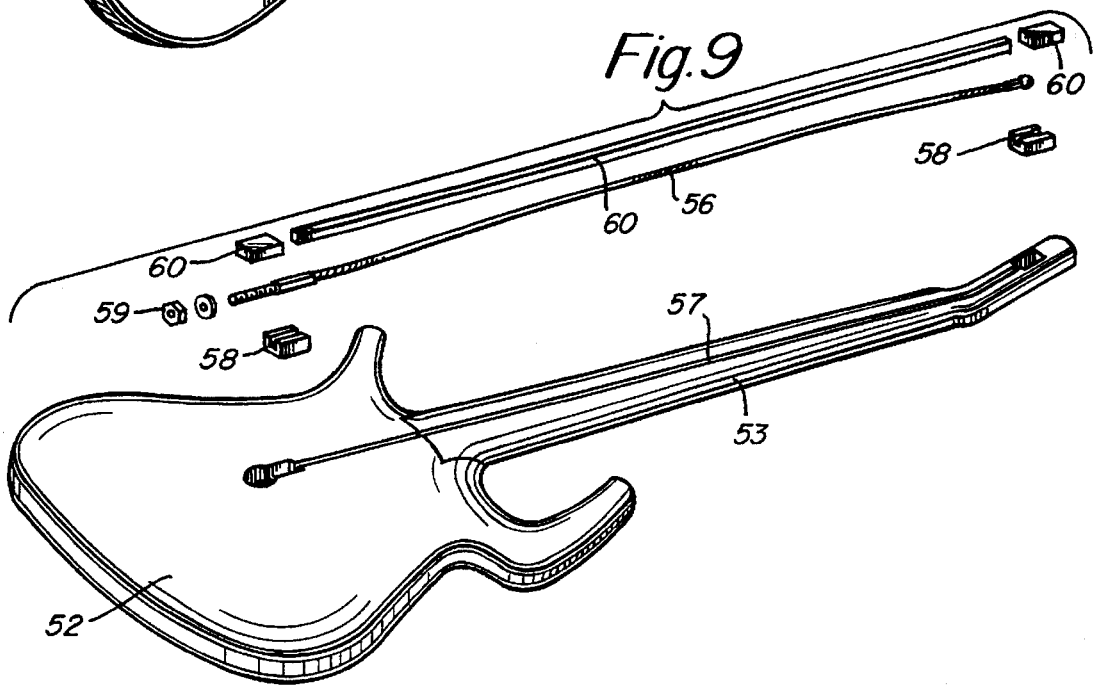

58
60
78
53
75
64
92
56
52
62
91
16
94
26
95
27
96
93
-
+

VIBRATO FOR A STRINGED MUSICAL INSTRUMENT

CROSS-REFERENCE TO RELATED APPLICATIONS

The present application is a continuation-in-part application of co-pending Ser. No. 08/275,157, filed Jul. 14, 1994; which is a continuation-in-part application of Ser. No. 07/862,975, filed Apr. 3, 1992, now U.S. Pat. No. 5,337,644; which is a divisional application of Ser. No. 07/352,154, filed May 15, 1989, now U.S. Pat. No. 5,125,312. Each of these applications and patents is expressly incorporated by reference.

FIELD OF THE INVENTION

This invention relates to stringed musical instruments, and particularly to a vibrato for an electric stringed musical instrument, such as a guitar.

BACKGROUND OF THE INVENTION

Guitars typically have a body, a neck extending away from the body, and a peghead at the end of the neck. Strings are coupled under tension to pegs on the peghead, extend over a bridge that is mounted in the body, and are coupled at the bridge. In some guitars, the bridge is rigidly mounted in the body. In others, the bridge is mounted so that it is rotatable relative to the body. With a rotatable bridge, a player can rapidly change the tension, and therefore the pitch, of the strings to produce a tremulous, musical effect while playing. The player moves the bridge with a generally L-shaped bar that is mounted in the bridge. The rotatable bridge, the bar, and the other components for mounting the bridge are called a vibrato (such a device is also commonly known as a "tremolo").

Typical vibratos have two to five identical coil springs, each of which has one end rigidly connected to the bridge, and another end coupled to a bracket that is screwed into the body at a location between the bridge and the neck, i.e., the springs extend from the bridge toward the neck. These coil springs provide a tension that counteracts the tension of the strings.

When the guitar is not in use, the bridge is at a central or neutral position. In some guitars, from the neutral position, the bridge can be rotated relative to the body in either direction, and thus the bridge "floats." U.S. Pat. No. 4,638,711 discloses a bridge that can be selectively locked so that it is fixed, and unlocked so that it floats. A user locks and unlocks the bridge by rotating a control arm that is rigidly interconnected to a latch. The latch selectively interengages a catch mounted in the guitar body.

Some guitars have a bridge that can be moved in one direction relative to the neutral position, but not in the other. In some such guitars, a back portion of the bridge extends over and abuts an outside surface of the body in the neutral position. Consequently, the back of the bridge cannot move away further toward the body, but it can move away from the body. Therefore, the bar can be pushed toward the body to raise a back portion of the bridge, but cannot be pulled away from the body. This is referred to as a classic design.

SUMMARY OF THE INVENTION

The present invention features a vibrato that can be adjusted in a number of ways so that it can accommodate various playing styles. Some of the adjustments can be made on the fly, i.e., while playing and without the use of any tools, while other adjustments can be made with accessible tool openings. The bridge can be moved so that it operates in a number of different manually selectable modes.

The vibrato includes a movable bridge mounted in a guitar body, a bar mounted in a bushing in the bridge, and a compression spring that extends from the bridge to a position away from a neck. The spring is preferably a generally flat compression spring that is coupled at a first end to the bridge and at a second end to a support. The preferred way to couple the spring at each end is to provide in the bridge and the support notches into which an end of the spring extends. Thus, the spring preferably abuts the support and the bridge under a force without being rigidly connected to them.

The support is linearly movable toward and away from the bridge so that the compression can altered as desired. The support is preferably a t-bar having a notched top bar portion that faces the spring and a post that extends away from the spring and into a bore in a threaded rod. A wheel having a threaded inner diameter is screwed over the rod. The rod extends into a sleeve in the body and mates with the sleeve in such a way that the rod cannot rotate relative to the sleeve. The wheel extends outside the body so that it is manually rotatable from the front or the back of the guitar. When the player rotates the wheel, the rotational movement is translated into linear movement of the rod and thus the support relative to the bridge, thereby causing the compression on the spring to be increased or decreased.

At the first end, the spring is coupled to a spring block that is rigidly connected to the bridge and that extends along the thickness of the body, perpendicular to the strings of the instrument. Adjacent the bridge is a manually adjustable stop that allows the player to selectively block movement of the support so that the bridge can be adjusted between a floating mode and a classic mode. The stop is preferably a step stop that has an upper step and a lower step. When the step stop is adjusted to a first position, the upper step abuts a portion of the block to prevent the block, and hence the bridge, from moving in one of two directions from a central position. In a second position, the support is spaced from a lower step and thus the bridge can move in both directions, i.e., it floats.

The bridge is moved with a bar that extends into, and is rotatable with, a hexagonal bore in a rotatably mounted bushing in the bridge. The portion of the bar within the bore has a slight bow so that the frictional force between the bowed portion and the interior of the bushing is sufficient to keep the bar from easily falling out of the bushing. This force should not be too great, however, because it is desirable for the player to be able to easily remove and reinsert the bar. The frictional force between the bushing and the bridge can be adjusted with a set screw that extends through a bore that is perpendicular to the portion of the bar in the bushing. To reduce play between the bar and the bushing, the bar and the bore in which it is disposed preferably have a hexagonal cross-section.

The bridge is rotatably mounted to posts that are held in the body. A threaded rotatable bolt extends into each of the posts. The bolts each have a head that is held in the body so that when the bolt is turned, the post and bridge move relative to the body. Providing an adjustable height bridge allows a player to adjust the "action", i.e., the distance between the strings and a fingerboard; also, it allows the player to adjust the bridge if the angle between the neck and the body moves with time.

Accordingly, with manual adjustments that can be made on the fly, the bridge can be placed in three distinct modes:

floating, classic and fixed. By setting the step stop to the lower step and the spring force adjusted to a balanced condition, the bridge is in the floating mode such that it can be moved in both directions from a neutral, central position. By adjusting the step stop to the upper step, the bridge is in the classic mode in which movement is stopped in one direction, but not in the other. From this classic mode, a user can remove the bar from the bushing and increase the compression on the spring so that the bridge is effectively in a fixed mode. Each of these steps can be performed manually on the fly.

A vibrato according to the present invention is particularly useful in conjunction with the manufacturing technique that is preferably employed. Since the preferred manufacturing technique is used to make a thin, light-weight instrument, e.g., as little as 1.5 inches at a front end of the bridge, it can be difficult to provide all of the desired features in the body. For example, if magnetic pickups are mounted in the body at a position near the bridge between the bridge and the neck, it would be difficult to have both the magnetic pickups and the tension coil springs in the same part of the body since the body may be too thin to accommodate both. Since the compression spring extends away from the neck, the vibrato and magnetic pickups do not interfere with each other.

A vibrato guitar according to the present invention is adaptable to certain playing styles that can otherwise cause problems. Some players like to rest a hand on the bridge while playing, thus providing a force at a back portion of the bridge. This force can move the bridge and thus cause the strings to go out of tune. By adjusting the step stop as described above, the player can prevent the bridge from moving when he/she rests his/her hand on the bridge, while allowing the player to still use the vibrato when desired by lowering the bar toward the body.

Some players employ a technique known as string bending in which a string is pulled or pushed sideways to raise the string's tension and therefore the pitch of the note. String bending can rotate the bridge, however, thus altering the pitch of the other strings. Consequently, if a chord is played and one spring is pulled, the other strings go out of tune. According to the present invention, this problem can be alleviated by significantly increasing the compression on the spring, so that string bending will not cause movement of the bridge. The player still retains the option of using the vibrato in the classic mode.

The flat compression spring improves sound compared to prior tension coil springs because the flat spring transmits the strings energy more positively and with less noise than coil springs. This is true because coil springs have noise in each turn and because the individual coils twist and rub together.

BRIEF DESCRIPTION OF THE DRAWINGS

Other features and advantages will become apparent from the following detailed description and from the drawings in which:

FIG. 7 is a perspective view of a wood core of the instrument;

FIG. 8 is a perspective view of assembled wood parts;

FIG. 9 is a perspective view of a rear surface of the guitar, further illustrating a tensioning cable employed in accordance with the invention;

DETAILED DESCRIPTION

Figure 1:
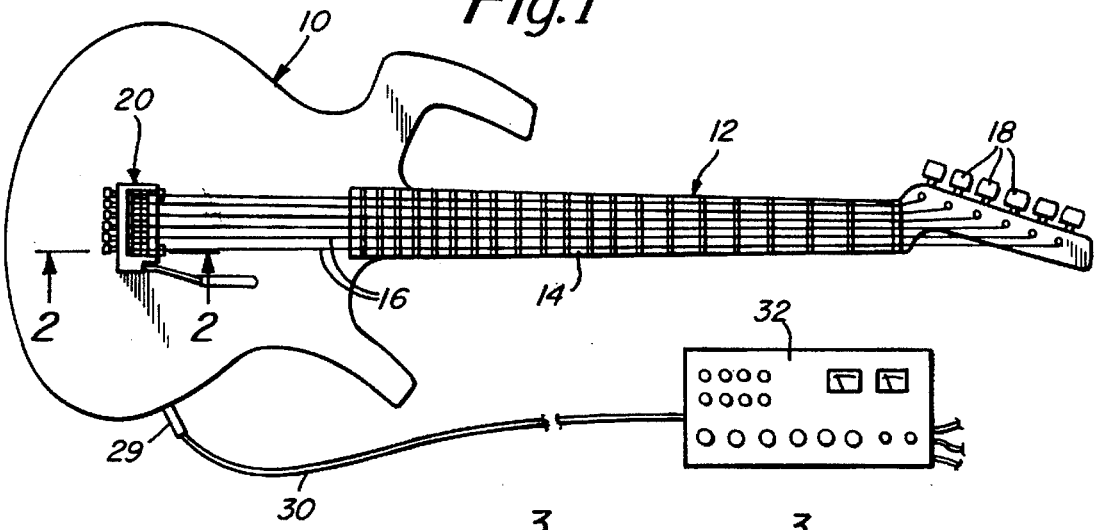
FIG. 1 is a plan view of a guitar constructed in accordance with the present invention.

Referring to FIG. 1, a guitar constructed in accordance with the present invention has a body 10 and a neck 12, which supports a fret board 14. Strings 16 are supported at the neck and at the body. At the neck, the strings may be supported in a conventional fashion with adjusting pegs 18. Strings 16 are supported at the body end at a bridge mechanism 20.

Figure 2:
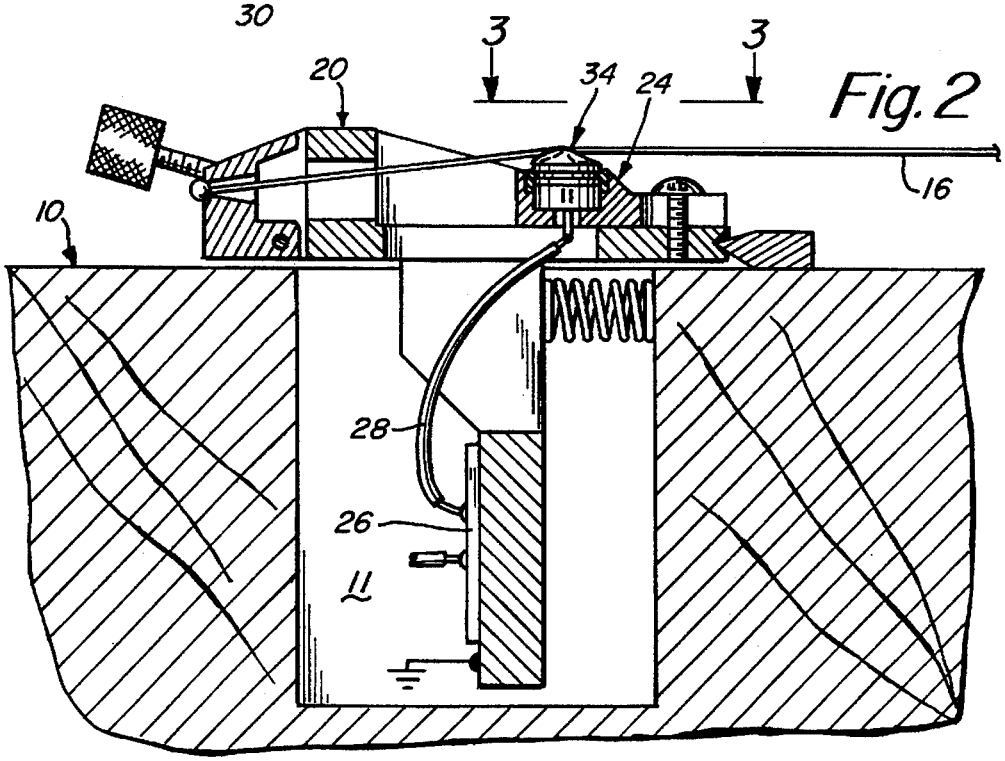
FIG. 2 is a fragmentary cross-sectional view showing details of a transducer system employed on the instrument.
Figure 3:
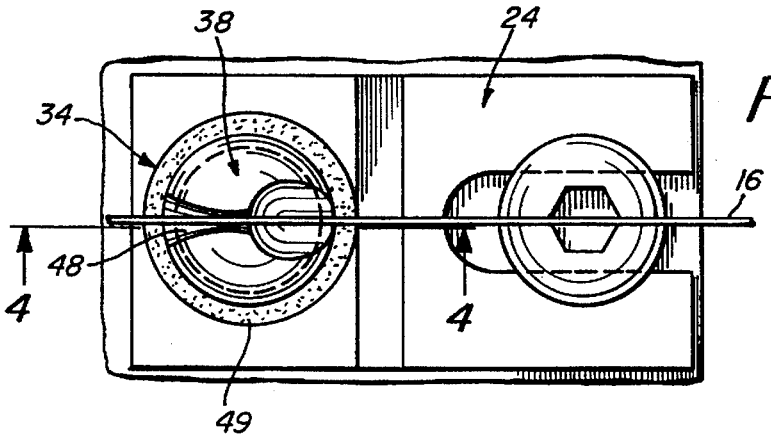
FIG. 3 is a plan view taken along line 3—3 of FIG. 2.

In FIGS. 1–3, bridge mechanism 20 is illustrated as a tremelo bridge, however, the bridge mechanism may also be a fixed bridge type. Bridge mechanism 20 is partially received in a cavity 11 in the instrument body. For further details of parts of the bridge mechanism, refer to Fishman, U.S. Pat. No. 4,911,057, issued Mar. 27, 1990.

The bridge mechanism 20 includes a holder 24, which in a fixed bridged construction would be held in a fixed position, although one might be adjustable. The bridge mechanism 20 also supports a circuit board 26 supported in the cavity 11. As shown in FIG. 3, a lead wire 28 connects a piezoelectric transducer to circuit board 26. A jack 29 and a cable 30 are connected to an electronic device 32, which may an amplifier or synthesizer. Inside the guitar, circuit board 26 may have lines coupling to jack 29 so that signals from the piezoelectric crystals are coupled by cable 30 to device 32.

Figure 4:
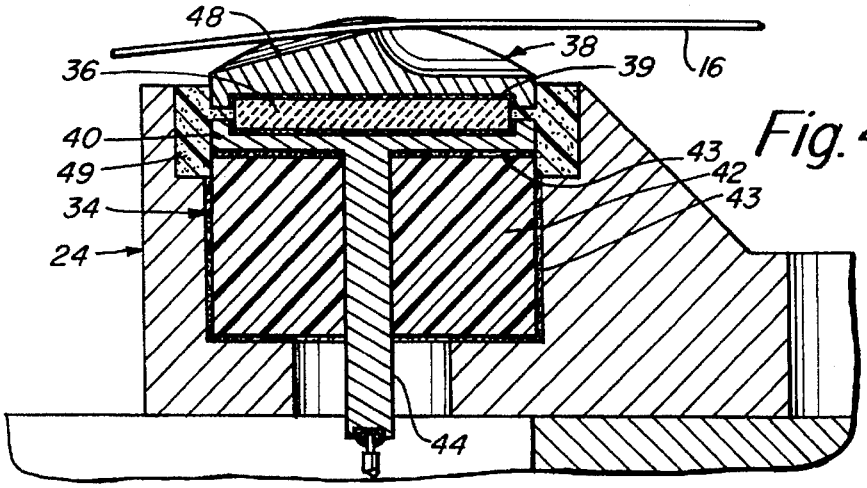
FIG. 4 is a cross-sectional view taken along line 4—4 of FIG. 3 and showing further details of the transducer construction.
Figure 5:
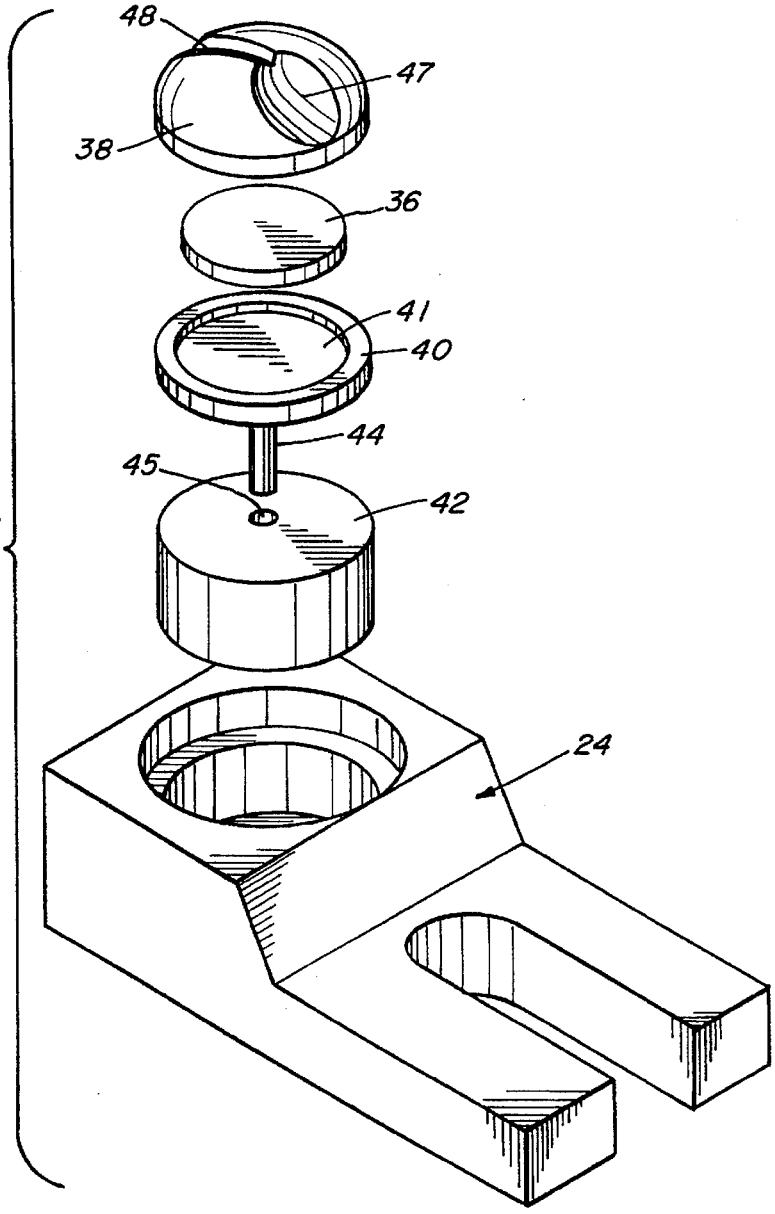
FIG. 5 is an exploded perspective view of the components of the transducer illustrated in FIGS. 2–4.
Figure 6:
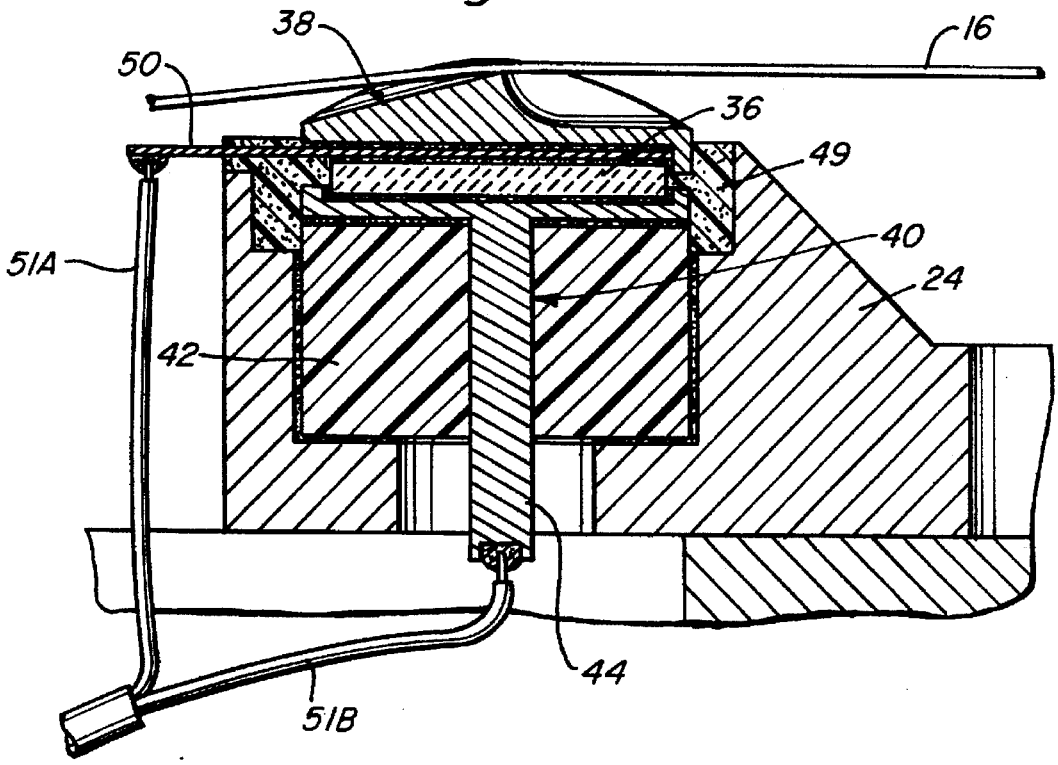
FIG. 6 is a cross-sectional view of an alternate embodiment of the transducer.

FIGS. 2–6 illustrate transducer assembly 34 secured in holder 24. Transducer assembly 34 includes a thin piezoelectric disk 36, a cap member 38, a metallic member 40, and a dielectric member 42. The facing surfaces of the cap member and metallic support member have recesses such as the recess 41 (FIG. 5). These recesses partially accommodate piezoelectric disk 36. Metallic support member 40 has a terminal post 44 that is adapted to pass through hole 45 in dielectric base member 42. As shown in FIG. 4, terminal post 44 extends downwardly below the bottom surface of dielectric base member 42. A lead wire is soldered to the bottom end of terminal post 44. Cap member 38 is of generally domed construction. Within the domed cap member a recess 47 is contiguous with a slot 48. Musical string 16, as shown in FIG. 3, is disposed in slot 48.

To secure the piezoelectric crystal 36 in place between the cap member 38 and the support member 40, a conductive adhesive layer 34 may be applied. This electrical layer couples the oppositely disposed upper and lower electrodes of the piezoelectric crystal to the respective cap member and metallic support member. Cap member 38 is electrically coupled by way of string 16 to other metallic parts of the guitar which may be considered as functioning as a ground. Non-conductive dielectric bonding 43 is provided to secure metallic support member 40 and dielectric member 42 as well dielectric member 42 and holder 24. A dielectric potting compound 49 is disposed about the transducer assembly.

In the transducer assembly, cap member 38 is preferably constructed of a hard metal material such as of stainless steel. The piezoelectric disk is of a piezoelectric crystal material. The metallic support member may be constructed of a softer metal material, such as brass. The adhesive materials may be epoxy adhesives, either conductive or non-conductive as previously described.

In one prior transducer construction, such as that illustrated in U.S. Pat. No. 4,774,867, the piezoelectric disk is bonded essentially only on one surface to increase output voltage. For this application, it is preferred to have the crystal bonded on both upper and lower faces with conductive epoxy 39. Bonding on both surfaces provides a more accurate output signal and better representative of the true mechanical string vibration. By essentially clamping both sides of the crystal a lower output voltage is provided. This means that the crystal is less sensitive to the compressive mode but is more sensitive to the rotational shear mode. This clamping better replicates the true mechanical string vibration. The hardness of potting compound 49 is instrumental and can be controlled so as to provide an accurate replication of the desired string vibration signal. Potting compound 49, in particular allows one to tune the shear mode, thus controlling the level of lateral clamping. The amount of clamping relates to the durometer hardness of the potting compound that is employed.

The piezoelectric type of transducer of the present invention is an improvement over previously used magnetic transducers. These magnetic transducers, inter alia, are generally more cumbersome and require the use of ferrous strings. The piezoelectric transducer is more readily tunable and is constructed to desensitize the compressional mode. As such, the transducer is constructed to be less responsive to mechanical vibrations, such as those from the instrument body.

With a piezoelectric transducer of this type, one can electronically add resonance to replicate a magnetic transducer. In this way a wide variety of sounds can be provided with piezoelectric transducers. Also, the piezoelectric type of transducer does not have to be used with ferrous strings but can be used with any type of string material.

As shown in FIG. 4, if a string breaks, the ground path is interrupted. As this may be of concern, an embodiment of the invention such as that illustrated in FIG. 6 may then be employed. The transducer assembly has cap member 38, metallic support member 40, dielectric member 42, and piezoelectric disk 36, which are mounted in substantially the same way as described in connection with FIG. 4. A conductive epoxy adhesive is used for securing the piezoelectric disk. Between the top surface of the piezoelectric disk and cap member 38, conductive leaf 50 extends outwardly. Leads 51A and 51B are solder connected respectively to leaf 50 and to terminal post 44. In an alternate arrangement, in place of the solder-connections illustrated in FIG. 6, a push on connector may be provided in place of the solder thus simplifying construction. With the arrangement of FIG. 6, should string 16 break, there is still an electrical connection to ground by way of lead 51A.

Figure 35:
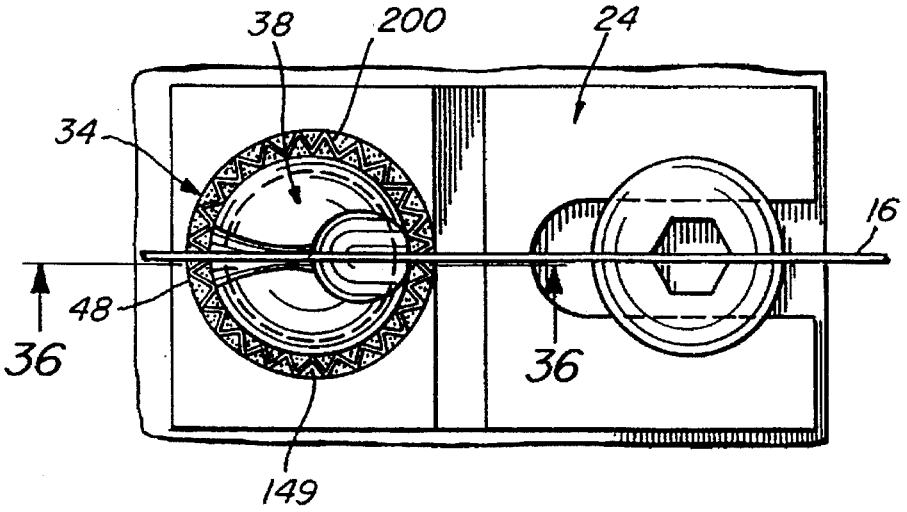
FIG. 35 is a plan view of an alternative embodiment of the transducer assembly and is similar to FIG. 3.
Figure 36:
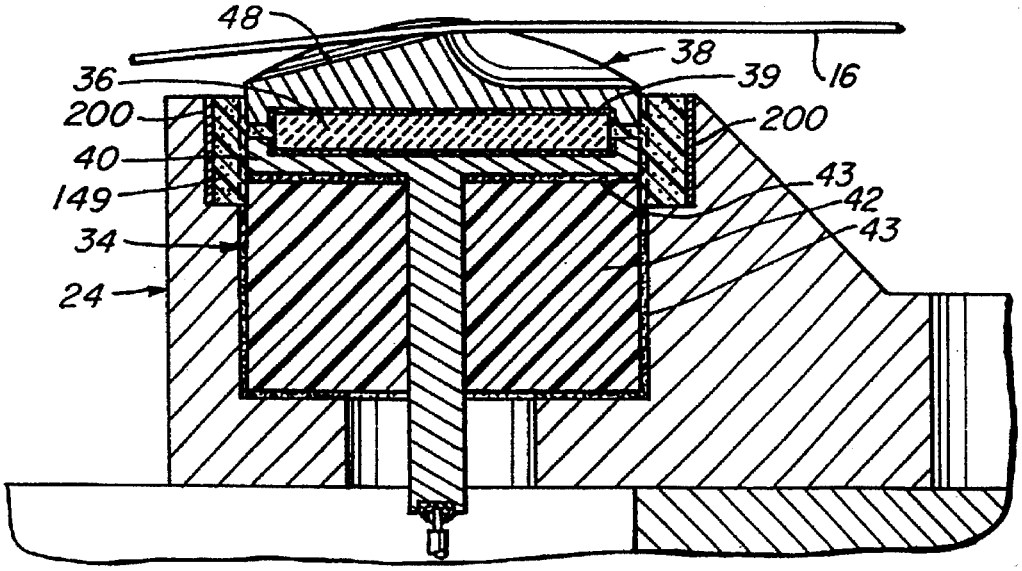
FIG. 36 is a cross-sectional view taken along the line of 36—36 of FIG. 35.

An alternative arrangement to that shown in FIGS. 3 and 4 is shown in FIGS. 35 and 36. A spring 200 that is preferably made from a strip of beryllium copper is provided around cap member 38 and provides an electrical path between cap member 38 and metallic member 40. The spring is preferably arranged in a corrugated manner to provide a conductive path while still being resilient to provide more accurate vibration detection. A compound 149, similar to compound 49 in the embodiment of FIGS. 2 and 3, may be provided in the space along with the spring 200.

As an alternative to the corrugated copper spring, stainless steel wool can be used since it too is conductive and also resilient. Since the wool is made from stainless steel, it does not rust like typical steel wool.

FIGS. 7–12 illustrate details relating to the construction of the guitar invention. A body 52, a neck 53 and arms 54 have a basic wood core. Body 52 and arms 54 may be cut from about 1½ inch thick redwood material, while the neck 53 is preferably cut from about 1 inch Douglas fir or bass wood. The arms may be separate pieces, or body 52 and arms 54 may be integrally formed from a single integral block of wood.

The wood core materials are preferably soft wood materials which are lighter in weight and are more well balanced tonally than hard woods that are typically used. Such woods are also less expensive, easier to cut and shape, and dimensionally stable than a hard wood core. With a soft wood core, rigidity and strength are provided with a laminate construction according to the present invention, in combination with a stiffening or tensioning cable.

Referring to FIG. 9, a metal cable or rod, such as a stainless steel cable 56, is received in an elongated recess 57 extending along the neck and into the body. A pair of anti-rotation pieces 58 are connected at each end of cable 56. A nut 59 is used to tighten and control the tension applied by cable 56. Filler pieces 60 are disposed over the cable and over the anti-rotation pieces to fill recess 57.

As an alternative to cable 56, a non-braided, thin metal wire having a dimension of about 0.060" to about 0.078" can be used. An example is described in connection with FIG. 34 below. This smaller wire reduces the weight relative to the use of a thicker, braided cable. Furthermore, the non-braided cable is easier to swage.

The cable may alternatively be secured from the opposite side, such as from the front side of the guitar, in which case the recess would be provided in the front surface.

As indicated, the cable 56 is preferably installed and adjusted from the back of the instrument to provide a clean appearance from the front. The cable can be positioned very close to the back surface of the instrument where it has the most mechanical advantage. The cable adjusts in a place that is convenient in that there is no need to loosen strings or otherwise disturb the instrument to provide this adjustment. Also, since the cable is flexible, adjustment may be made nearly anywhere on the instrument, including at the neck end of the cable or at the body end.

Figure 10:
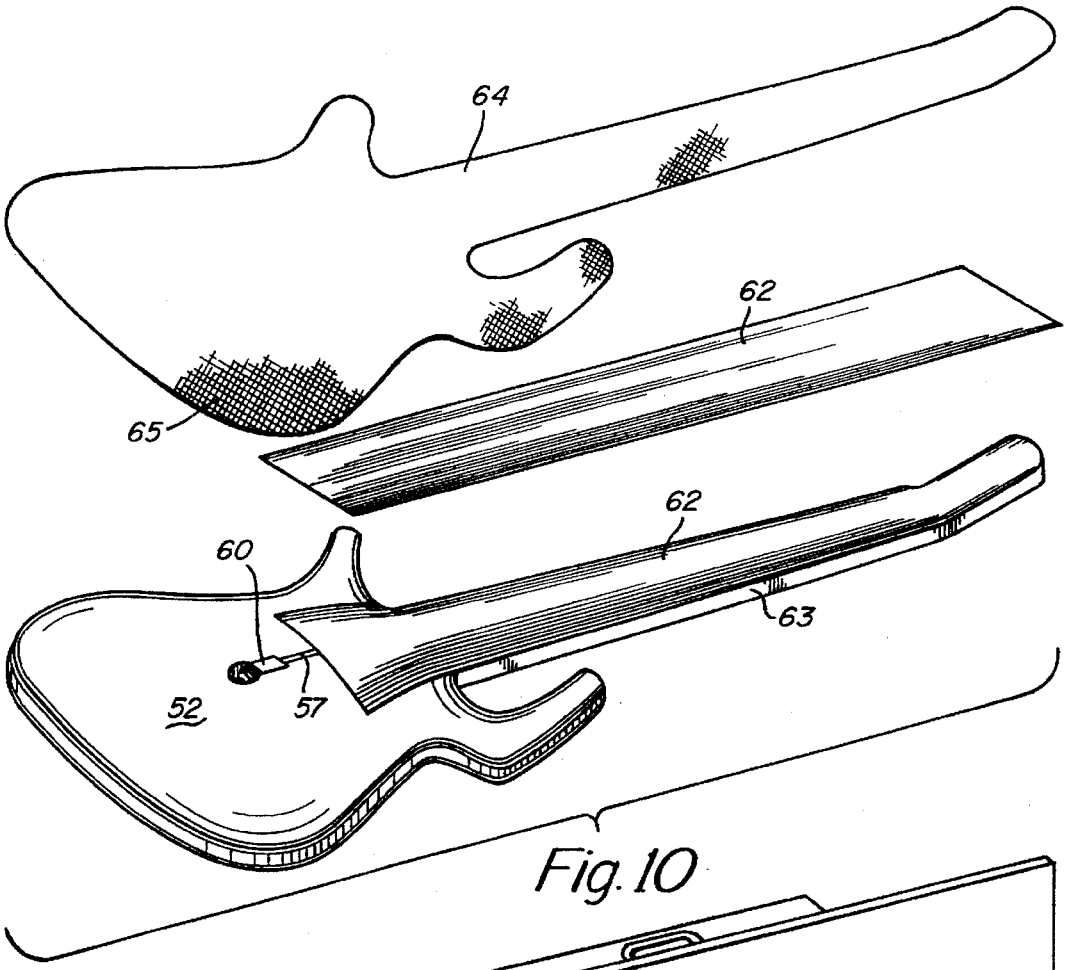
FIG. 10 is an exploded view of components employed in fabricating the guitar, including carbon fiber and fiberglass layers.
Figure 11:
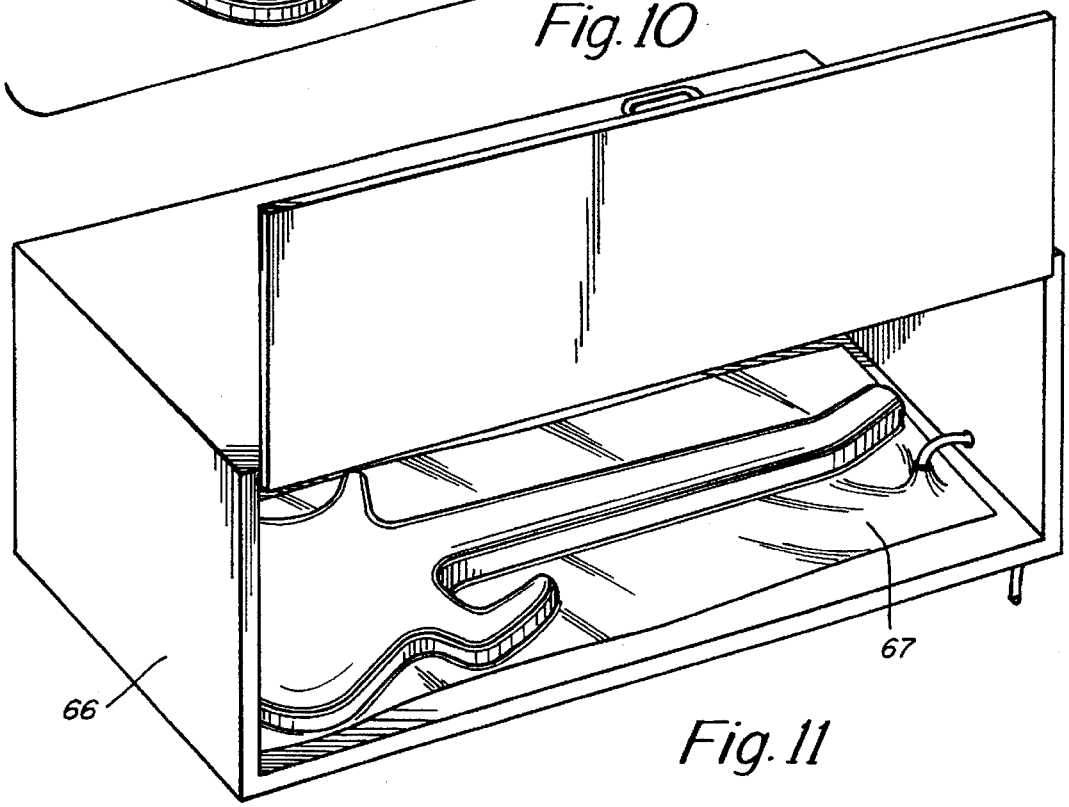
FIG. 11 is a perspective view of a guitar in the process of fabrication.

Referring to FIG. 10, after the body of the guitar has been contoured to the desired configuration, the neck is secured by gluing to the body, preferably using a high temperature epoxy. The glue joints may be angled to facilitate the shaping of the guitar without excess waste of material. In preparing the instrument for the lamination process, a support caul 63 is provided. The stiff caul screws to the fingerboard surface and extends to the body of the instrument. The laminate includes multiple layers 62 of unidirectional carbon fiber are impregnated with a high temperature epoxy resin, and a fiberglass cloth layer 64. Layer 64 is preferably applied with a 45° bias as illustrated at 65. The 45° bias cut enables the fiberglass to better conform to the curves of the core. Layer 64 covers the back of both the body and the neck and can also covers the sides and front of the body as well. The fiberglass cloth is also impregnated with a high temperature epoxy resin. Each of these layers may be about 0.010 inch thick. The fiberglass cloth layer is bias cut and may have a thickness of about 0.003 inch.

Caul 63 supports the neck and headstock in their correct alignment and insures good playability. The caul, which is first treated with a mold release, silicone material, provides a place for the extra laminating material to go and prevents the undesirable condition of excess laminating material being bonded to the fingerboard surface.

After layers 62 and 64 have been impregnated, they are pressed onto the instrument and the laminate is then ready for curing. The guitar is disposed in a vacuum bag 67 (FIG. 11) and placed in an oven 66. The vacuum bag provides clamping pressure for the lamination. The curing occurs at a temperature of about 250° F. for two hours.

Figure 12:
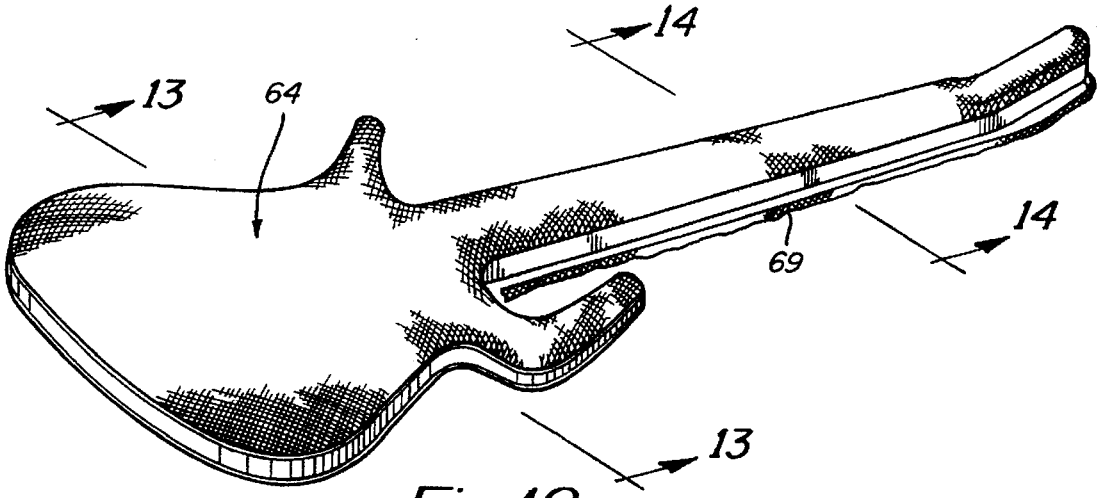
FIG. 12 is a perspective view of the guitar construction after the heating and curing step.

After the instrument is cured, the caul is removed and excess material is knifed off. The laminated edges are smoothed. The headstock and fingerboard surfaces are prepared. In this regard, FIG. 12 shows the instrument after being cured. Sharp edges may be radiused by sanding. Excess material such as illustrated at 69 in FIG. 12 may be trimmed off.

Figure 13:
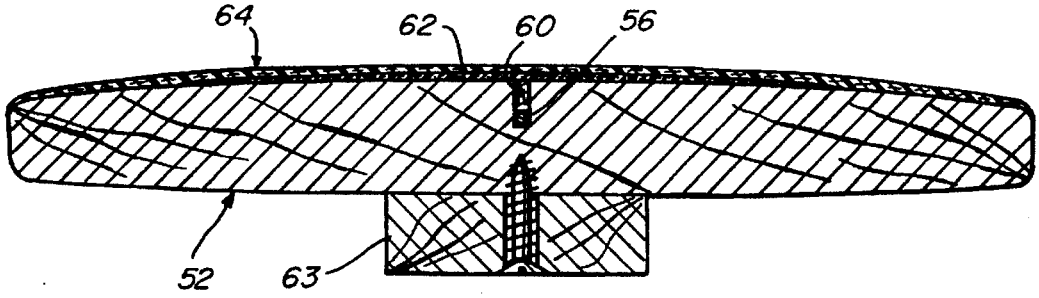
FIGS. 13 and 14 are cross-sectional views taken along the lines 13—13 and 14—14 of FIG. 12, respectively.
Figure 14:
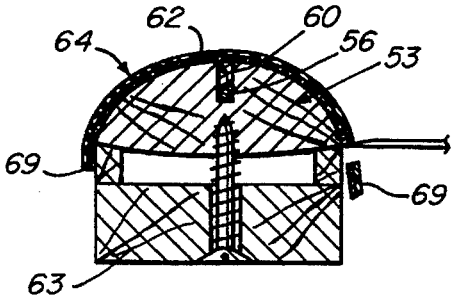

Referring to FIGS. 13 and 14, the cross sectional views are taken at an intermediate step in the fabrication of the guitar. In both FIGS. 13 and 14, caul 63 is still shown affixed to the wood core. FIGS. 13 and 14 also show tension cable 56, the filler piece 60, carbon fiber layer 62 feathered at the edges, and fiberglass layer 64. These same layers are also illustrated in FIG. 14. FIG. 14 also illustrates the excess laminate being trimmed at 69.

Figure 15:
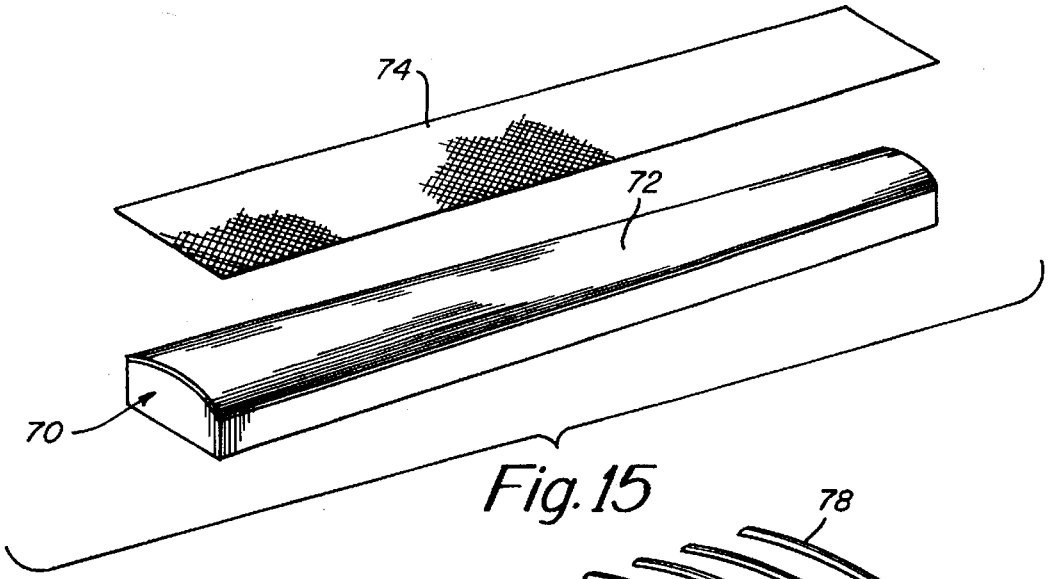
FIGS. 15 and 16 are exploded views of step in the fabrication of the fingerboard.
Figure 16:
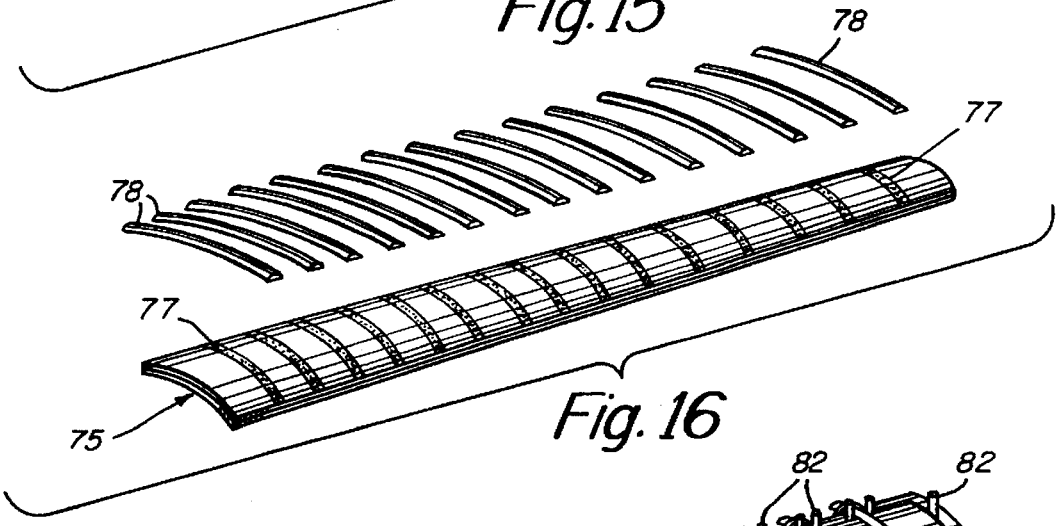

Reference is now made to FIGS. 15–18 for further details in the construction of the instrument fingerboard. In this regard, FIG. 15 shows a basic form 70 that is used to provide the proper contour for the fingerboard. On the top surface of the form 70, a release material, such as a gel, is preferably provided to enable the laminate components to be separated from the form. On top of the form, a uni-directional carbon fiber layer 72, and a bias cut fiberglass sheet 74 are provided. Both layer 72 and sheet 74 may be impregnated with a high temperature resin. The combination of the carbon fiber and the fiberglass on the form is subjected to high temperature in an oven. The arrangement illustrated in FIG. 11 with the use of a vacuum bag may be employed for heating and curing to form laminate 75 as illustrated in FIG. 16.

FIG. 16 shows laminate 75 after having been formed by heating and after having also been trimmed to the proper size for a particular instrument. On the top surface of laminate 75, a mask is employed and the laminate is sandblasted using a mask to form roughened strips 77. These strips are disposed at positions corresponding to positions where the frets are to be secured. Frets 78 are cut to a proper length and partially curved to substantially match the curvature of laminate 75. The underside surface of the frets is also preferably sandblasted. The frets may be cut from a length of stainless steel material of cross-section as shown, for example, in FIG. 23. After sandblasting both the frets and the laminate, epoxy adhesive is applied to enable the frets to be secured onto the laminate. Thus, the frets are made of extremely hard wire, preferably stainless steel, in a construction that is tangless.

Figure 17:
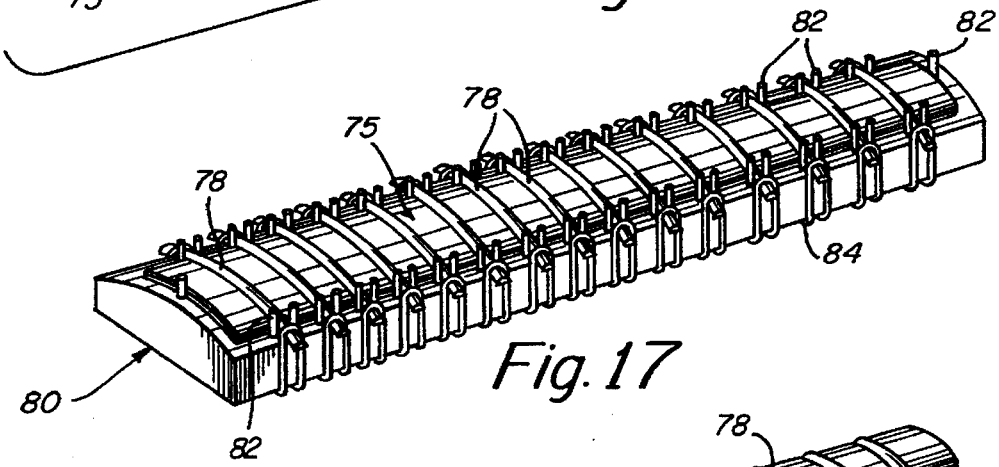
FIGS. 17 and 18 are perspective views of further steps in the fabrication of the fingerboard.
Figure 18:
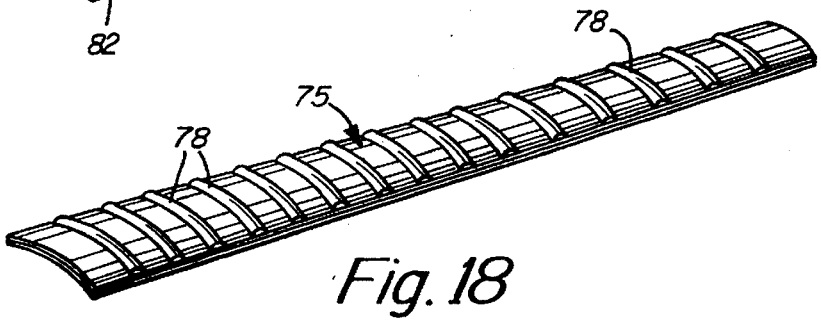

As shown in FIG. 17, a fixture 80 has several locating pins 82 disposed at opposite ends of the fixture 80 for positioning the laminate board longitudinally. Locating pins 82 also locate frets 78. Rubber bands 84 hold frets 78 securely against the laminate 75. With the laminate and frets in the position illustrated in FIG. 17, the assembly is baked. FIG. 18 shows the final fret board including the laminate with the individual frets attached after the ends of the frets are cut and finishing work is done.

Figure 22:
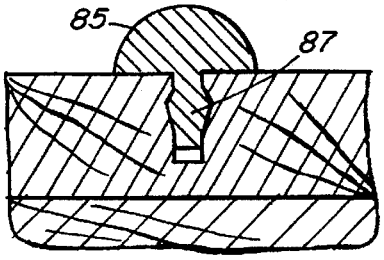
Fig. 22 (PRIOR ART)
FIG. 22 is a fragmentary cross-sectional view of a prior art fret construction.

Reference is now made to FIGS. 19–23 for further details of the fingerboard construction. FIG. 22 in particular shows a prior art tanged fret construction. FIG. 22 shows a conventional fret 85 having a tang 87. These individual frets are constructed of a relatively soft material and are hammered into a slot in the fret board. After the fret has been inserted into the fret board it must then be reformed. The formation of a fret board in this manner is quite time consuming and costly. Because a relatively soft metal is employed, the fret board has to be reworked in the future. On the other hand, according the present invention, the frets are of a hard metal. Rather than inserting these frets into a slot in the fret board, they are adhesively secured to the surface of the fret board. The fret construction of the present invention requires little or no reworking after the frets are applied.

Figure 19:
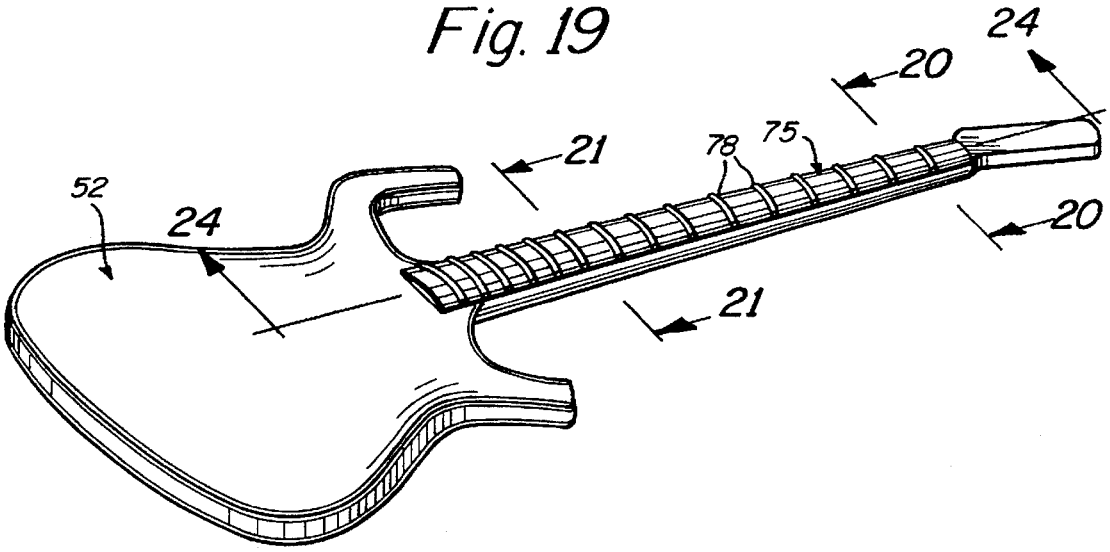
FIG. 19 is a perspective view of the fingerboard of FIG. 18 secured to the neck of the instrument.
Figure 20:
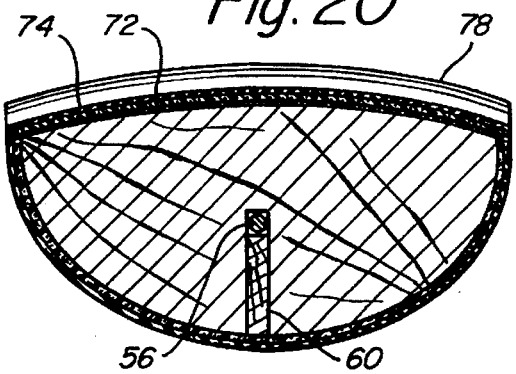
FIGS. 20 and 21 are cross-sectional views taken along lines 20—20 and 21—21 of FIG. 19, respectively.
Figure 21:
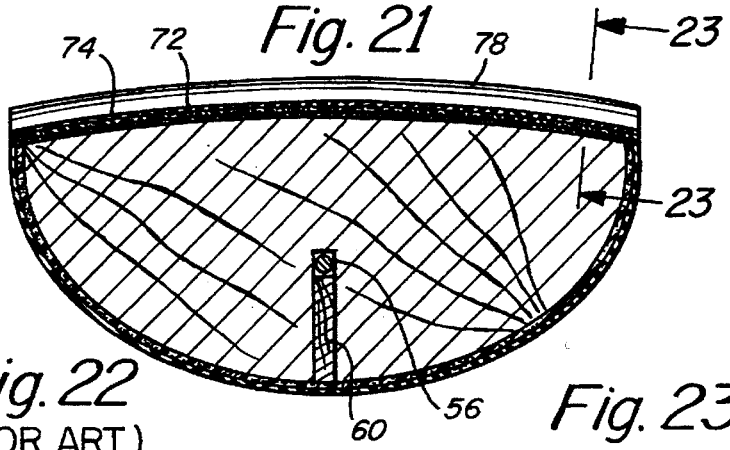

FIG. 19 is a perspective view showing the fingerboard attached to the guitar neck. The fingerboard may be secured to the instrument neck using, for example, a thin film adhesive. This may be provided in a relatively thin film on the order of 0.002 inch thick. Films of this type are preferred over the use of an applied liquid because the films are dimensionally stable and provide an accurate adhesive layer. One thin film adhesive that has been employed is a thermal plastic film adhesive that can be applied and provides sealing by application of heat. Also, one can employ an unsupported acrylic film adhesive. This does not require the application of heat. The adhesive that uses the application of heat may be preferred in that this will make it easier to remove and replace the fingerboard, simply by the application of heat.

Figure 23:
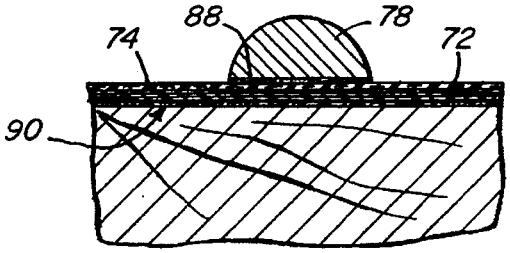
FIG. 23 is a cross-sectional view taken along line 23—23 of FIG. 21 showing the fret construction in accordance with the present invention.

Frets 23 may be bonded to the fret board laminate itself using instead a methylacrylate. Layer 88 for securing fret 78 to the laminate (FIG. 23). FIG. 23 also shows a thin film adhesive 90 for bonding the fingerboard structure to the guitar neck.

To secure the frets on the fingerboard, a material such as methylacrylate is particularly advantageous. Since it is an anarobic adhesive in which the cross-linking occurs in the absence of oxygen, only the concealed adhesive will harden and adhesive that is exposed to oxygen will not harden. This means that it will be easier to remove excess adhesive.

Figures 24, 25, 26:
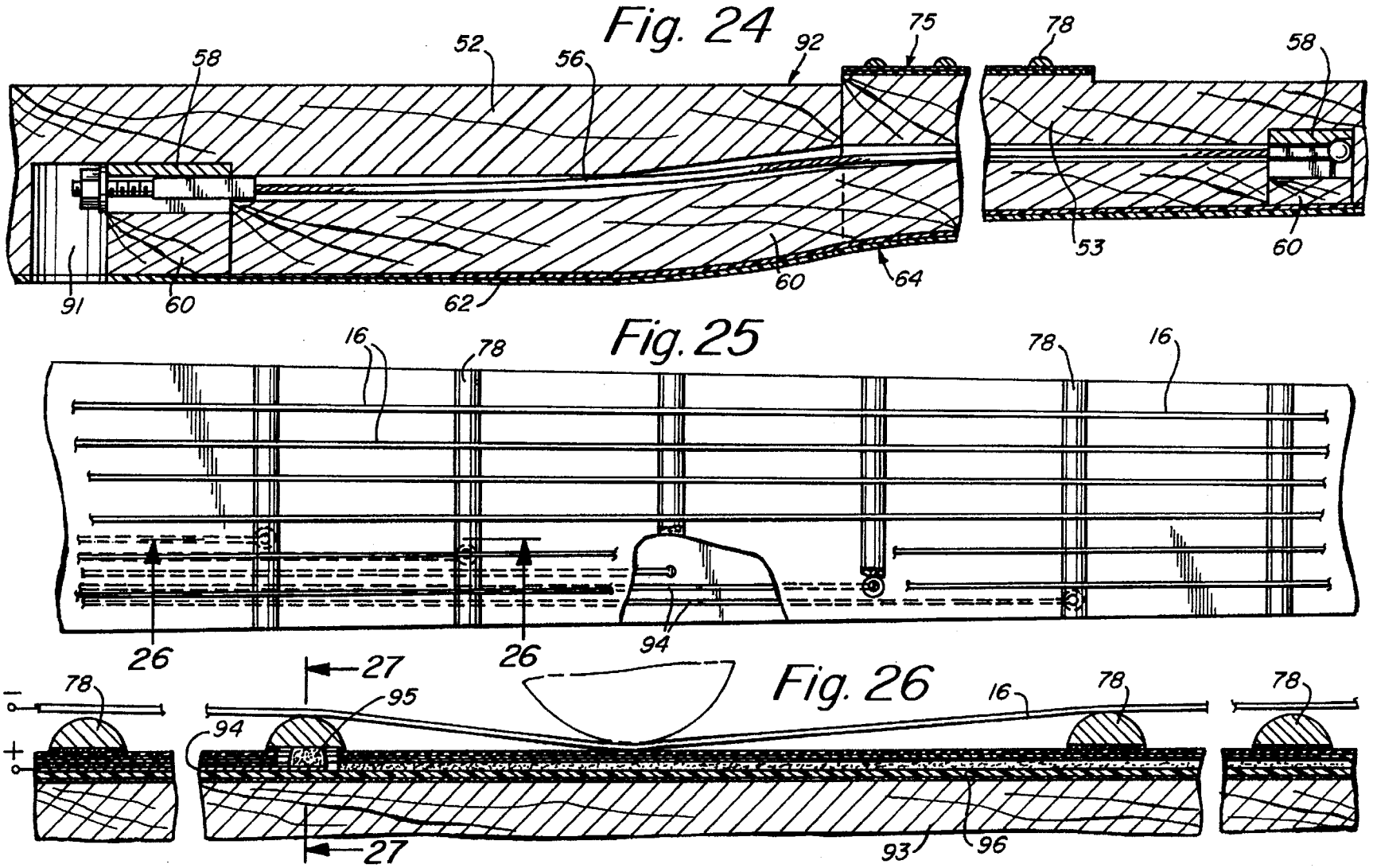
FIG. 24 is a longitudinal cross-sectional view taken along line 24—24 of FIG. 19.
FIG. 25 is a plan view partially in cross-section of a portion of the fingerboard.
FIG. 26 is a more detailed cross-sectional view as taken along line 26—26 of FIG. 25.

Reference is now made to FIG. 25 which is a longitudinal cross-sectional view taking along line 24—24 of FIG. 19. In FIG. 24, tensioning cable 56, which may be a stainless steel cable, is adapted to flex around any corners or curves. The ends of the cable are supported by anti-rotation devices 58. There is also a tension adjusting nut accessible from the hole 91. A portion of the fingerboard 75 is shown with the frets 78. The top surface 92 can be painted or may also be coated with at least fiberglass and perhaps also the carbon fiber. With the use of at least fiberglass coat there is a harder surface provided. FIG. 24 also shows the use of several wood filler strips 60. The underside surface is shown with its carbon fiber layer 62 and fiberglass layer 64. A heavy primer may be used to fill the rough surface of the fiberglass and then the instrument may be painted.

Figure 27:
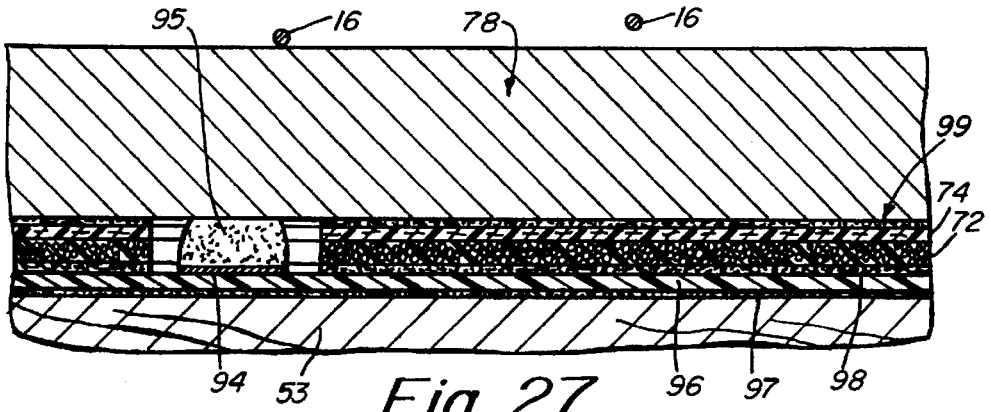
FIG. 27 is a further detailed cross-sectional view as taken along line 27—27 of FIG. 26.
Figure 28:
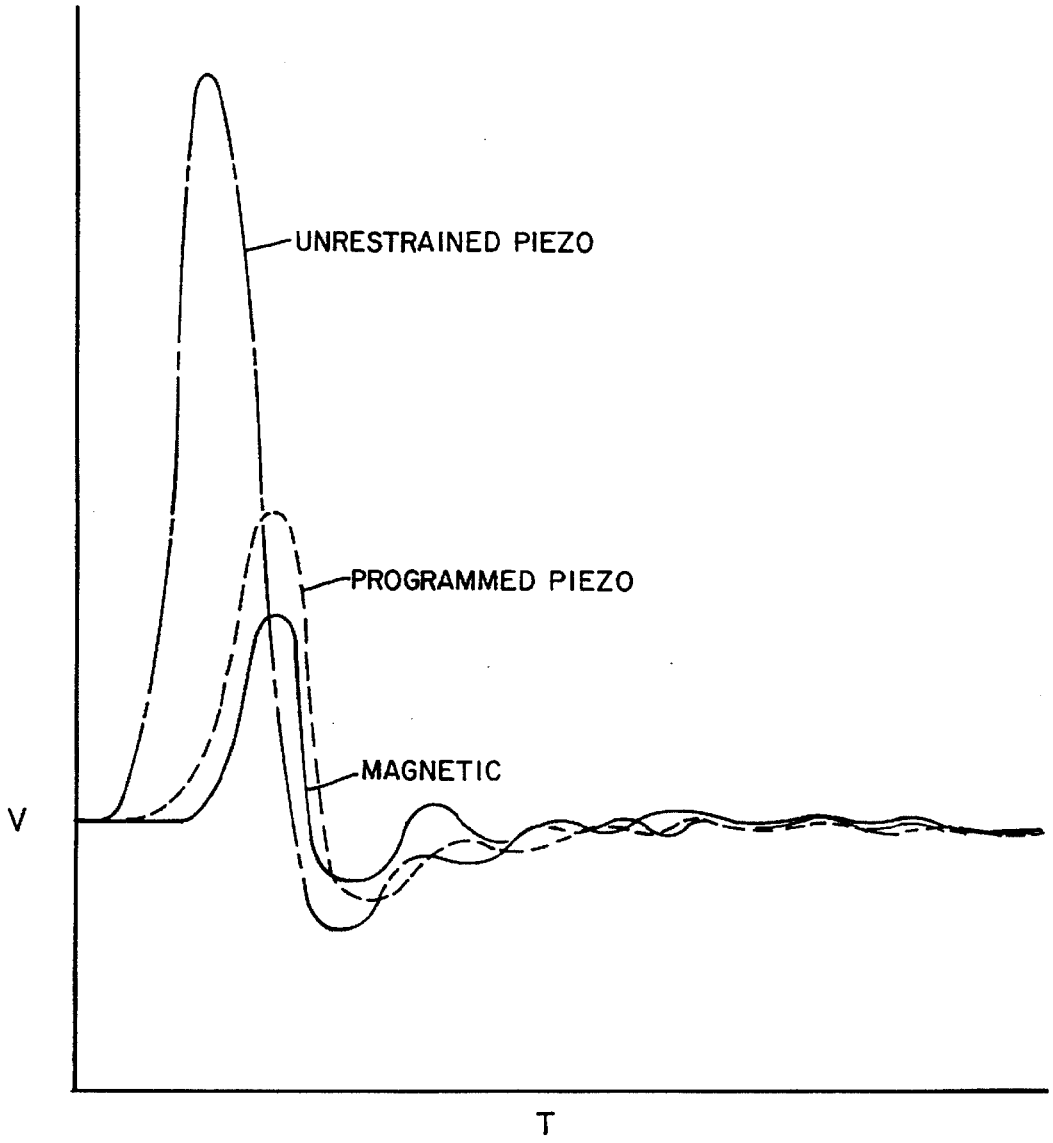
FIG. 28 is a graph relating to the transducer system described herein.
Figure 29:
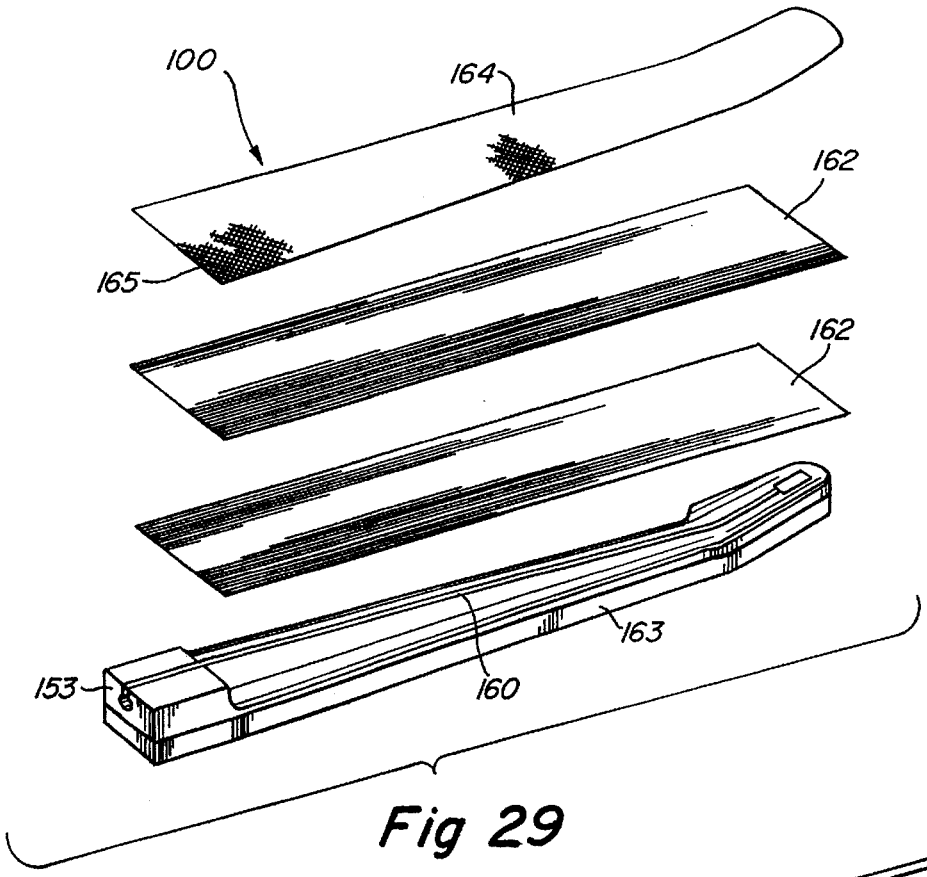
FIG. 29 is an exploded view of components employed in fabricating a guitar neck.

Referring to FIGS. 25–27, in an alternate embodiment of the invention, circuit runs are provided individually from each fret. When a fret is engaged with a finger such as that shown in FIG. 26, the conductivity between the string and the fret can be sensed by one of the circuit runs. Such a signal can be coupled by way of cable 30 to electronic device 32. In this way, one can electronically sense the particular fret that is being engaged when in fact the string causes conductivity with the particular fret.

FIG. 25 shows the series of frets 78, as well as strings 16 and circuit runs 94. As illustrated in FIG. 26, a conductive epoxy dab 95 completes the electrical conductivity from fret 78 to circuit run 94.

In the embodiment of the invention illustrated in FIGS. 25–27, on top of the wood core there is directly provided a printed circuit board including dielectric substrate 96 which carries the circuit runs 94. An adhesive 97 secures the printed circuit board substrate. FIG. 27 also shows circuit run 94 as well as conductive epoxy dab 95. A non-conductive epoxy layer 78 is employed over the substrate to isolate the circuit runs. Also, there is an epoxy layer 99 or alternatively a methylacrylate adhesive is provided to secure the frets.

FIGS. 29–34 illustrate a method for making an instrument component, with a guitar neck shown as an example of one such component. A light-weight guitar neck 100 includes a wood core 153 which may be a soft wood, a flexible wire 180, filler pieces 160, and one or more layers 162 of unidirectional carbon fiber, each of which may be about 0.010 inch thick. The layers of carbon fiber, two of which are illustrated, are impregnated with a high temperature epoxy resin. A pre-impregnated (prepreg) material can also be used. To prepare the neck for lamination, a stiff support caul 163 is provided to support the neck and the headstock in selected alignment, to provide a place for the extra laminating material to go, and to prevent excess laminating material from being bonded to the finger board surface. The caul is first treated with a silicone mold release material.

A fiberglass cloth layer 164 is applied over the carbon fiber layers 162 with a 45° bias, as illustrated at 165, to enable the fiberglass to conform to the curves of the neck. Layer 164 is about 0.003 inches thick and is preferably impregnated with a high temperature epoxy resin.

Figure 30:
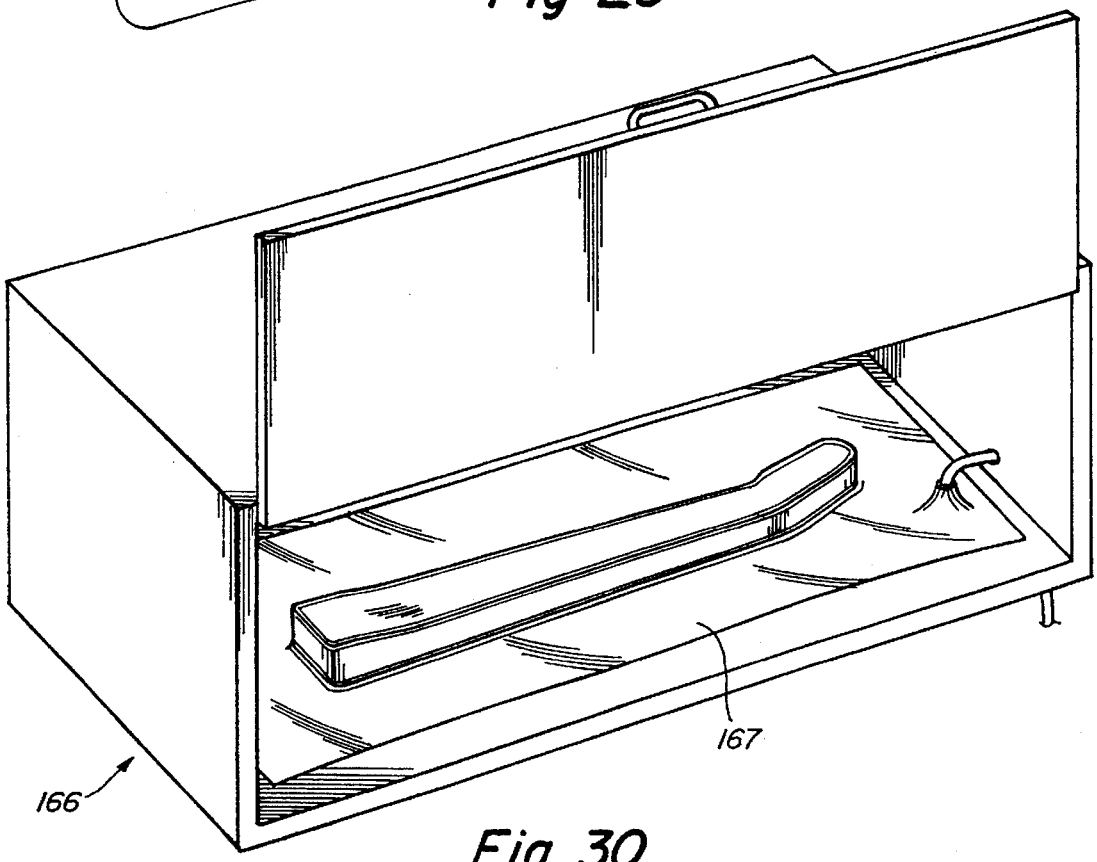
FIG. 30 is a perspective view of the guitar neck in an oven and vacuum bag for heating and curing.

After carbon fiber layers 162 and fiberglass layer 164 are impregnated with resin, they are pressed onto the neck core for curing. Referring to FIG. 30, the neck is placed in a vacuum bag 167 to provide clamping pressure for the lamination. The curing occurs in an oven 166 at a temperature of about 250° F. for about two hours.

After the neck is cured, the caul is removed, excess material is removed with a knife, and the laminated edges are smoothed. The headstock and fingerboard surfaces are then prepared. Sharp edges may be radiused by sanding, and excess material is trimmed.

Figure 31:
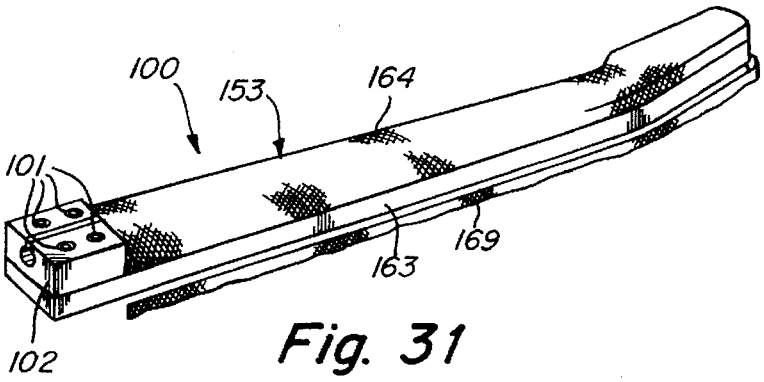
FIG. 31 is a perspective view of the guitar neck during construction according to the present invention.
Figure 32:
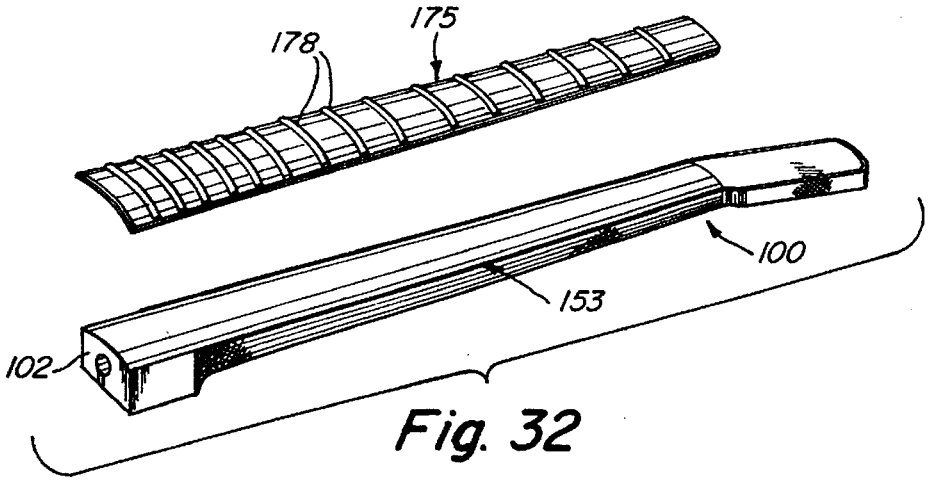
FIG. 32 is an exploded perspective view of the guitar neck and the fret board.

The light-weight neck may be secured to the body by a variety of methods, one of which is shown in FIGS. 31–34. Referring to FIG. 31, a series of threaded inserts 100 are disposed in core 153 at an end 102 of the neck. Referring to FIG. 32, fingerboard 175 with attached frets 178 is shown just prior to attachment of the fingerboard to the neck core 153.

Figure 33:
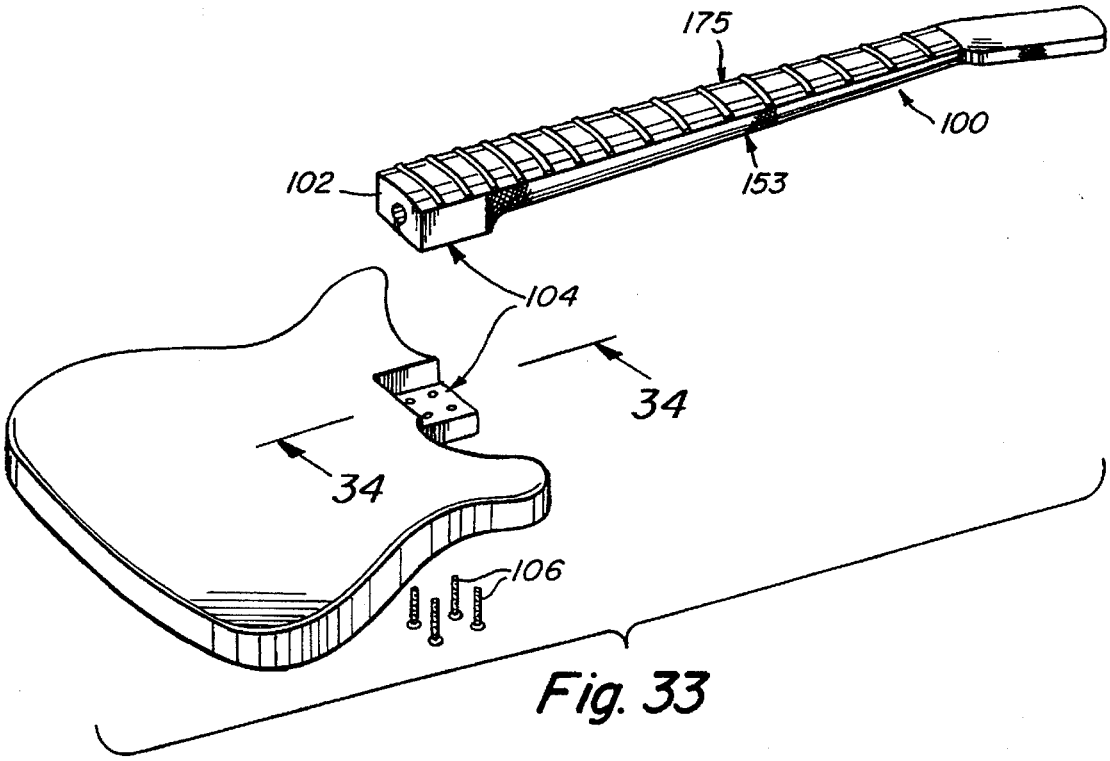
FIG. 33 is a perspective view of a guitar neck and guitar body.

Referring to FIG. 33, a half-lap joint 104 is constructed to join a planar surface of the guitar body and a planar surface at end 102 of light-weight neck core 153. A number of machine screws 106 are fed into screw holes the back of the guitar body and engage the threaded inserts in the neck. Other fitted joints, such as mortise and tenon joints can be constructed to engage respective surfaces of the guitar neck and guitar body. The neck and body may also be glued together. The fitted joints are typically used in conjunction with the glue.

Figure 34:
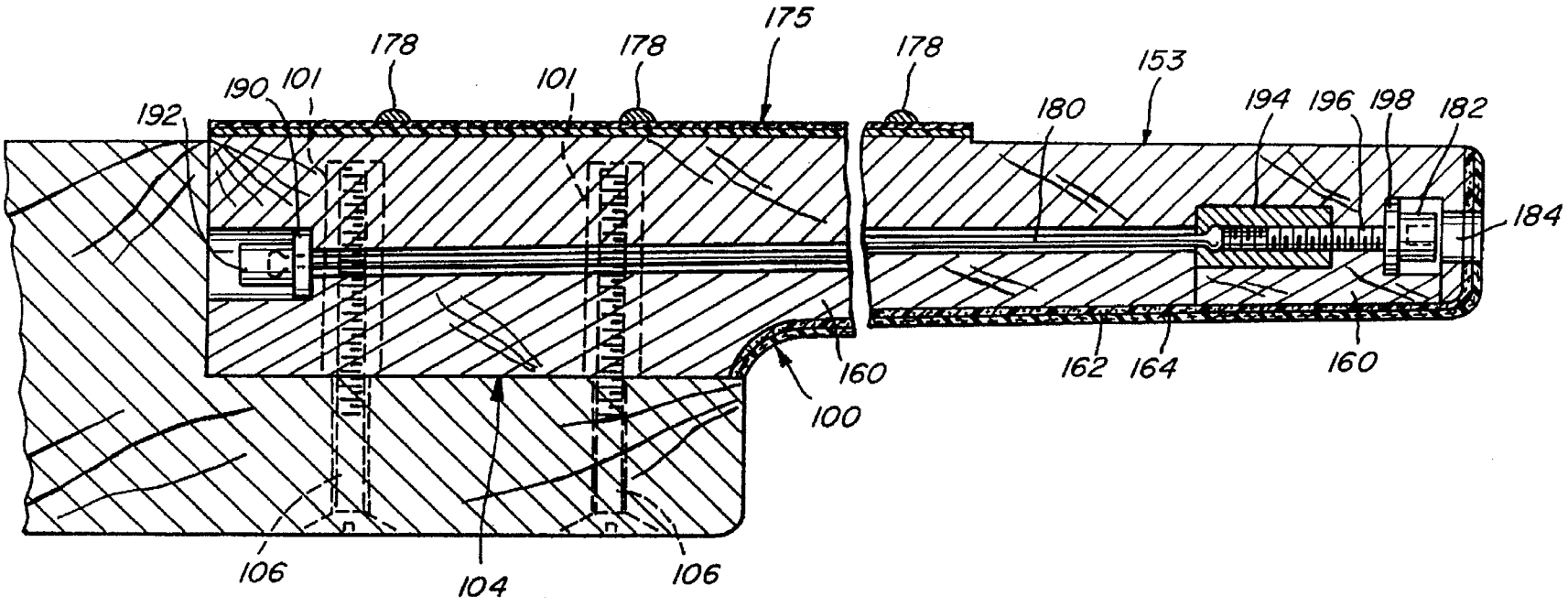
FIG. 34 is a cross-sectional view along 34—34 of FIG. 33.

Referring to FIG. 34, since the neck is formed as a separate piece, a tension wire 180 is provided completely within the neck. Wire 180 is preferably about 0.060 inches to about 0.078 inches and is preferably non-braided music wire. At the body end of the neck, a washer 190 is pressed against the opening for the wire, and a cap 192 is swaged over the end of the wire. Unlike some cables, since the wire is not braided, it is easier to swage. At the headstock end, an internally threaded anti-rotation fitting 194 is swaged onto the end of the wire. A washer 198, which is preferably made from metal, is placed over a screw 196 which is screwed into fitting 194. The tension adjusting screw is accessible through an opening 184 in the neck, and allows adjustment with an allen wrench, a screwdriver, a Torx wrench, or some other device that mates with screw head 182. Fitting 194 prevents rotation by having a rectangular shape and by being disposed in a slot that is also rectangular.

A vibrato as described in connection with FIGS. 37–47 has a number of features that provide great flexibility for guitar players. A vibrato according to the present invention has a bridge that can be set in different modes, including a floating mode, an effectively fixed mode, a classic mode. A player can adjust among these modes on the fly. This vibrato is particularly suitable for a thin and light-weight guitar made as described above.

Figure 37:
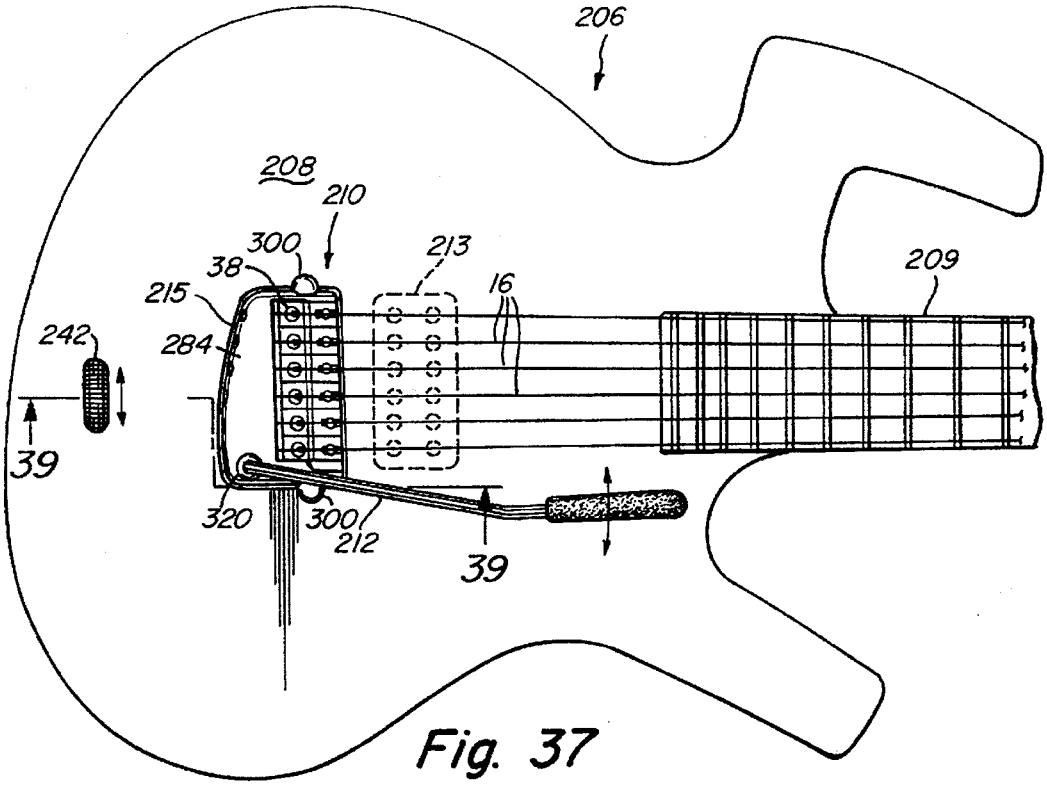
FIGS. 37 and 38 are partial front and rear elevational views, respectively, of a guitar body having a vibrato according to the present invention.

Referring to FIG. 37, a solid body guitar 206 has a bridge 210 rotatably mounted in a guitar body 208. Strings 16 are under tension and extend from a back end 215 of the bridge, over pickups on the bridge, across a portion of the body, over a neck 209, and to a peghead (FIG. 1). A control bar 212 extends into a bushing in the bridge. A player can increase or decrease the tension, and thus the pitch, of the strings by moving the bridge with the bar. Bridge 210, as shown in more detail in FIGS. 2–6 and 35–36, has six piezoelectric disks coupled to cap members 38 that serve as pickups for detecting vibration from the strings 16. The guitar may also have a magnetic pickup assembly 213 that is screwed into the front of the body near the bridge and between the bridge and the neck. Since the strings are under tension, their connection to the bridge causes a force that outwardly urges the back end of the bridge away from the body.

Figure 38:
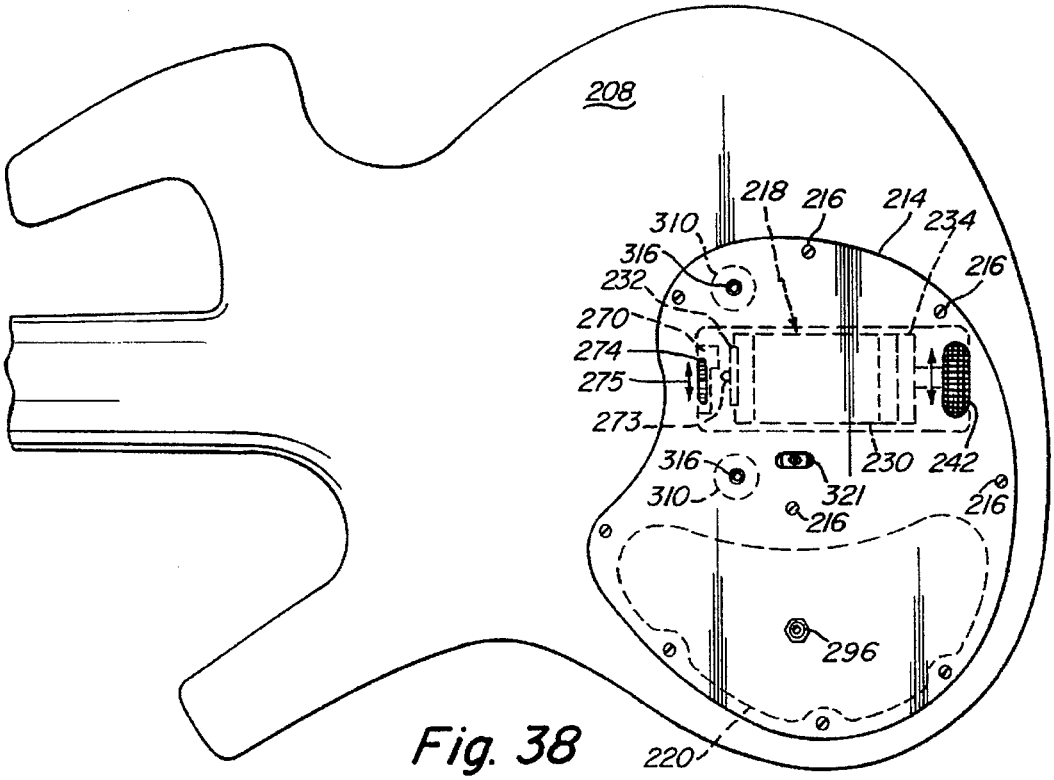

Referring to FIG. 38, on the back side of the guitar body, a plastic cover 214, held to the body with screws 216, covers both a spring assembly 218 and a compartment 220 that holds electrical components (not shown). Cover 214 has a number of openings where some adjustable members extend through the cover and where other adjustable controls are accessible through the cover. These adjustable members will be covered in more detail below as the features are discussed.

Figure 39:
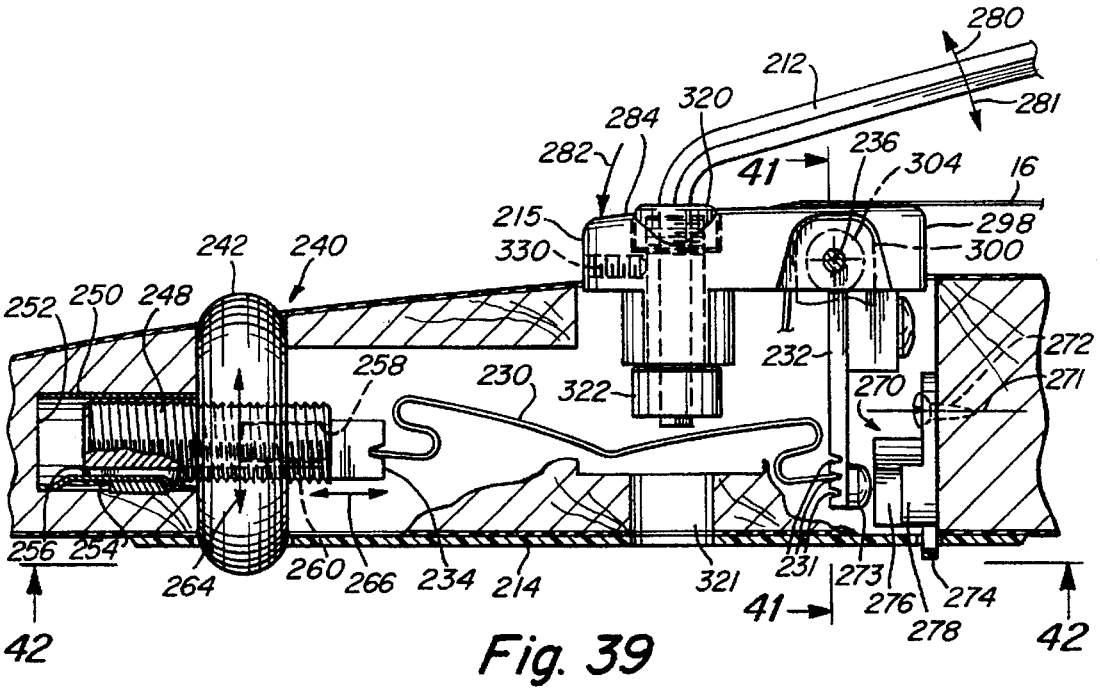
FIG. 39 is a partial cross-sectional view along section lines 39—39 of FIG. 37.
Figure 40:
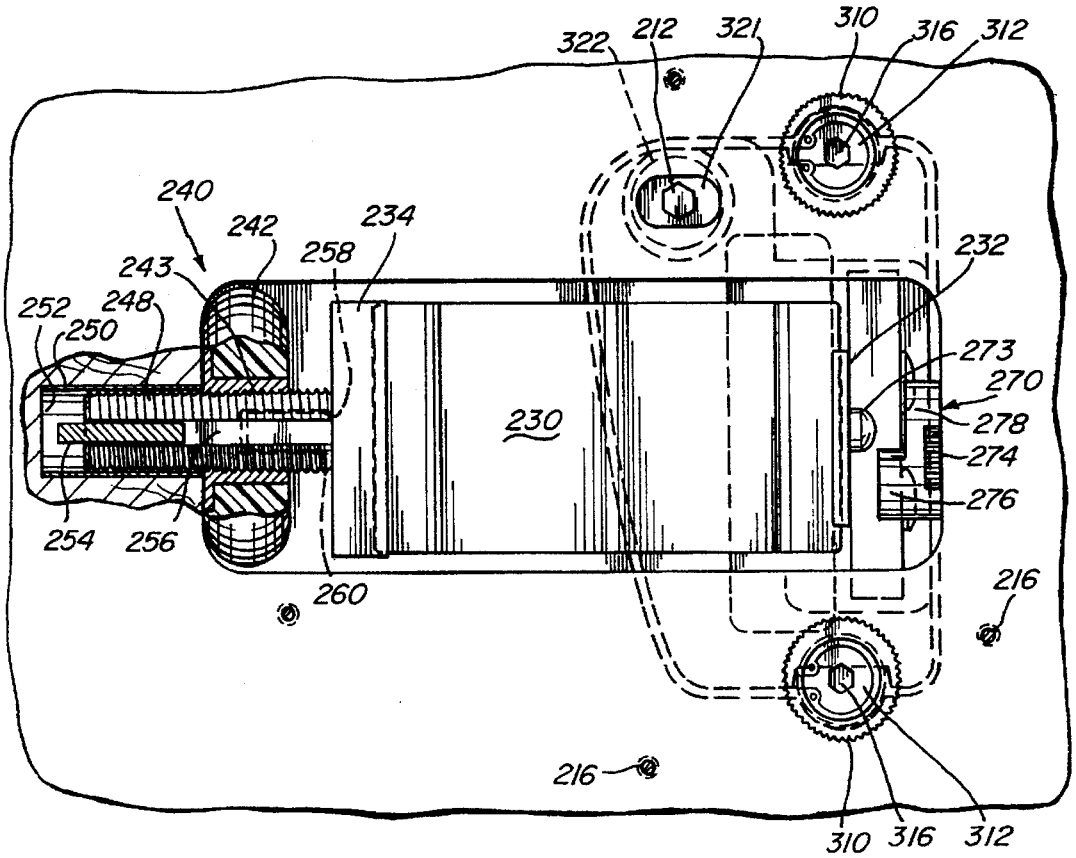
FIG. 40 is a partially broken away fragmentary view along section lines 40—40 of FIG. 39.

Referring also to FIGS. 39 and 40, the bridge is mounted to the body so that the bridge can rotate about an axis 236. A flat compression spring 230 is coupled to the bridge and extends away from the neck. The spring has a central, wide angle, V-shaped portion and S-shaped portions at each end.

Figure 46:
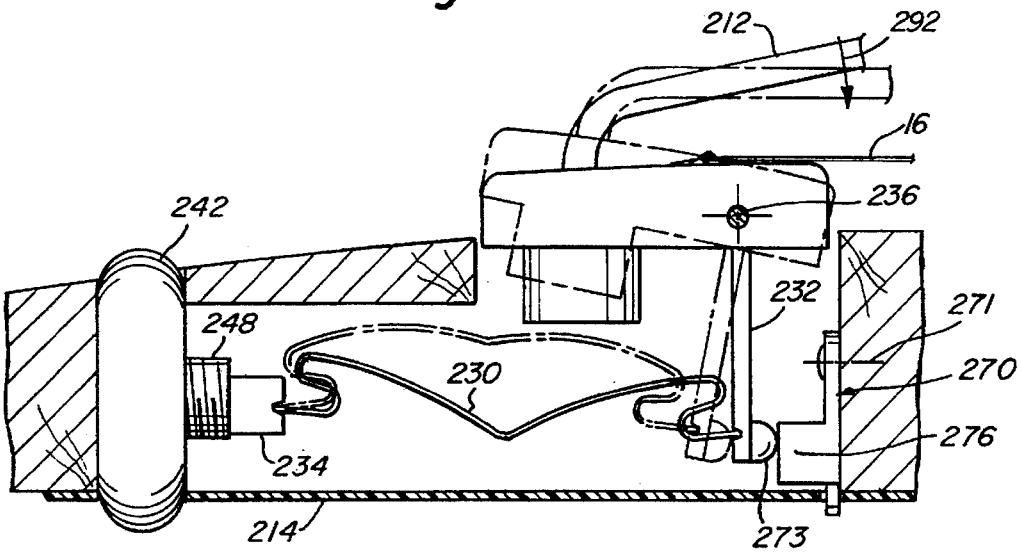

Because the S-shaped portions provide the spring with two extra fulcrum points at each end, the spring is a multi-rate spring. These portions position the V-shaped portion above the line between the ends of the spring, thus causing the spring to bend up as shown in FIG. 46. This design thus increases damping without also increasing the length of the spring. The spring is preferably about 1 5/16 to about 1½ inches wide.

At a first end, the spring is coupled to spring block 232 by abutting the spring block in one of three parallel notches 231. A user can select one of the three notches based on a desired compression force. At a second end, the spring 230 is coupled to a notched t-bar 234 that is part of an adjustable support assembly 240. Each end of the spring is smoothed and deburred so that it is slightly rounded within the respective notch.

While an abutting, non-rigidly-connected relationship is preferred, the term "coupled to" as used here with reference to the spring, describes the situation in which the spring abuts one of a support or block without being rigidly connected to it, and also to a situation in which the spring is rigidly connected to it.

T-bar 234 is linearly movable relative to the spring block so that a user can alter the compression of the spring. The t-bar has a post 260 that extends away from the spring and into a bore 258 in an end of an aluminum threaded bushing 248. The t-bar is not rigidly connected to the bushing, but stays in the bore due to the force exerted by the spring. Bushing 248 extends into and mates with a sleeve 250 that is disposed in a blind hole 252 in the body. The sleeve is generally cylindrical, but has a radially inward detent 254 that extends axially and serves as a key. The threaded bushing has an axial channel 256 that serves as a keyway for mating with the key. Thus the sleeve, which may be made of brass or plastic, serves as an anti-rotation mechanism relative to bushing 248.

A hard plastic, knurled wheel 242 that has a threaded wheel bushing 243 is screwed over threaded bushing 248. When a player rotates wheel 242 (arrows 264), the wheel bushing threadably engages bushing 248. Since the key and keyway prevent bushing 248 from rotating, the rotational movement of wheel 242 is translated into linear movement by bushing 248, and hence t-bar 23, in a linear direction (arrows 266). This linear movement relative to the spring block increases or decreases the compression force of the spring as desired. By adjusting this compression force, players can obtain balance (floating mode) or adjust the desired stiffness of the bridge (classic mode). As will be discussed below, the compression force can be increased substantially so that the bridge has no mobility in one direction (clockwise in FIG. 39).

At the other end of spring 230, spring block 232 is adjacent a plastic step stop 270 that is mounted with a screw 272 to the body of the guitar. The step stop is rotatable relative to the body about an axis 271 defined by screw 272 and has an integral handle 274 that extends through cover 214. The player manually moves the step stop with the handle (arrows 275, FIG. 38).

The step stop has an upper step 276 and a lower step 278. In a first position, the upper step faces and abuts a rear knob 273 of block 232, and thus the block and the bridge are stopped from moving in one of the two possible directions of rotation (counterclockwise in FIG. 39). Thus, if one moves bar 212 in the direction indicated by arrow 280, which also corresponds to a force being provided to back end 215 of the bridge as indicated by arrow 282, block 232 and bridge 210 do not rotate about an axis 236. Referring also to FIG. 37, this means that if a player rests his/her hand on a rear portion 484 of the bridge while playing, upper step 276 of the step stop prevents the bridge from moving, and thus prevents an inadvertent change in the tension of the strings. Thus, the guitar is in the classic mode (as shown below in FIG. 46). The player can still use the vibrato if desired by moving the bar in the direction indicated by arrow 281, i.e., toward the body so that the bridge rotates clockwise.

When the step stop is moved to a second position so that lower step 278 is spaced from the knob, block 232 is not impeded in either direction, and thus is in a floating mode (as shown below in FIG. 45).

Figure 41:
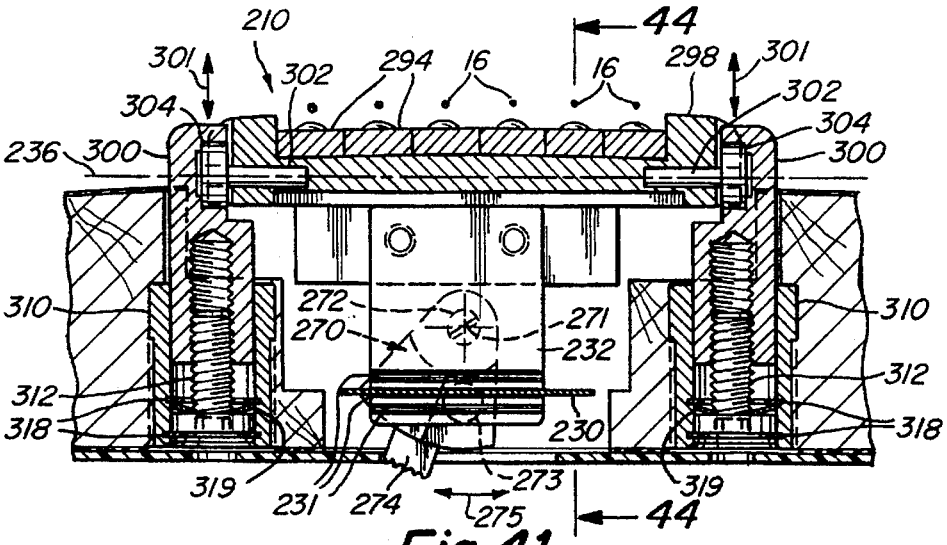
FIG. 41 is a cross-sectional view along section lines 41—41 of FIG. 39.

Referring to FIGS. 39–41 and particularly to FIG. 41, bridge 210 has piezoelectric pickups 294 for detecting vibration from strings 16 (see FIGS. 2–6). Pickups 294 are electrically coupled to circuitry (not shown) in compartment 220 which, in turn, is coupled to an output jack 296 (FIG. 38). These pickups are mounted on a main body 298 of the bridge.

The main body is connected to two linearly movable mounting posts 300. Pins 302, which are about ½ inch long, have ball bearings 304 that are press fit into mounting posts 300. The pins extend into bores in main body 298. The position of the bores and pins 302 define axis 236 about which the bridge rotates. The ball bearings and pins thus enable the bridge to be rotated relative to the body of the guitar.

Mounting posts 300 are movable relative to the body so that the height of the bridge can be adjusted (as indicated by arrows 301). Referring to FIGS. 40 and 41 posts 300 extend into, bushings 310 that are mounted in the body and that have knurled or slotted sides to prevent rotation. A threaded bolt 312 extends through each bushing 310 and into a threaded bore in each post 300. Bolts 312 are adjustable through cover 214 (FIG. 38) with an allen wrench for turning hexagonal openings 316. The bolts are held in place with snap rings 318 that snap into grooves in bushings 310. Between the snap rings is a Belleville spring washer 319 that maintains tension on the snap rings and reduces vibration.

This feature is useful for two reasons. First, different players prefer different action between the strings and the fret board. Some players, for example, prefer a greater distance so that it is easier to use a pick. The height adjustment allows a user to adjust the action. Second, the relative position of the neck and the body can change over time, particularly because of moisture. The height can therefore be adjusted to compensate for such relative position change.

Figure 42:
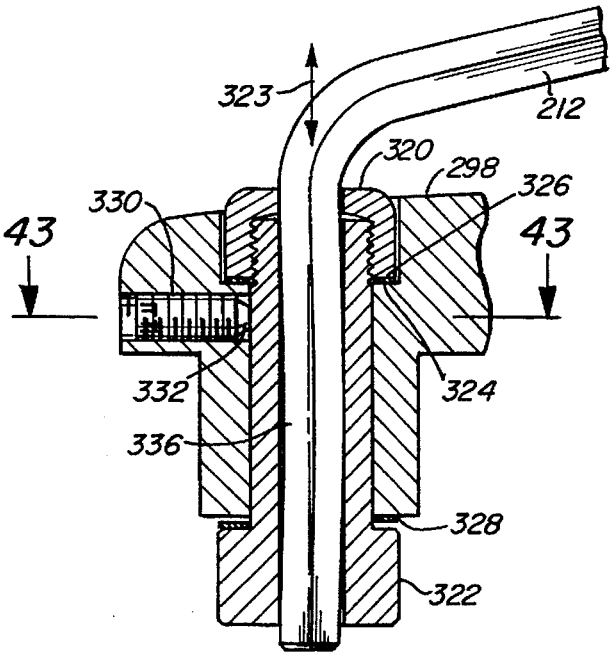
FIG. 42 is a fragmentary enlarged cross-sectional view of a bar and sleeve according to the present invention.
Figure 43:
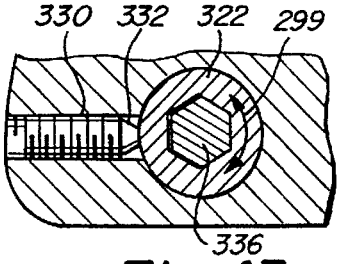
FIG. 43 is a cross-sectional view taken along section lines 43—43 of FIG. 42.

To rotate the bridge about axis 236 (defined by pins 304 as shown in FIG. 41) to create the tremulous effect, players move the bar in one direction and then rapidly move it back and forth. Referring to FIGS. 42 and 43, stainless steel bar 212 extends into an opening in an inverted, cup-shaped nut 320 that is threaded over a generally cylindrical bushing 322. Alternatively, the position of the nut and bushing may be reversed so that the bar extends first into the bushing. Unlike typical bars that are circular, bar 212 is preferably hexagonal in cross-section to reduce the play between the bar, the nut, and the bushing in a plane perpendicular to an axial dimension of bushing 322.

Nut 320 contacts a bronze washer 326 that rests on a shoulder 324 of main body 298 to prevent further inward movement of the nut. Bushing 322 has an increased diameter portion which forms a shoulder that abuts body 298 through a wavy spring washer 328. Washer 328 helps provide rotational friction and also reduces some of the play between bushing 322 and body 298. To rotate the bushing relative to the nut, a player can access the bushing through opening 321 (FIGS. 38–40).

Nut 320 and bushing 322 rotate together within the body 298 (arrow 299, FIG. 43). To adjust the frictional forces looser or tighter rotation, a set screw 330 having a nylon tip 332 extends into a bore that is roughly perpendicular to the bushing. This feature is useful because some players prefer to actuate the bar and then have the bar rotate downward and away from their playing hand quickly, while other players prefer to nudge the bar downward a short distance from where it can, if desired, easily be retrieved after being used. The set screw is easily adjustable to alter the rotational frictional forces between the bushings and the main body of the bridge.

A portion of the bar that extends into bushing 322 has a slightly bowed portion 336 that helps maintain a frictional fit within the bushing. The bow is shaped relative to the bushing so that it is held within the bushing, but fits loosely enough so that it can be easily withdrawn and reinserted if desired. Accordingly, if a player does not intend to use the vibrato and would prefer not to have the bar in the way, the bar can be easily removed. The frictional forces between the bowed portion 336 and the bushing are preferably the only forces that hold the bar in the bushing, meaning that there is no threading on the end of the bar for mating with the bushing, and no other perpendicular screws, bolts, or other mechanisms for rigidly holding the bar in the bushing.

Figure 44:
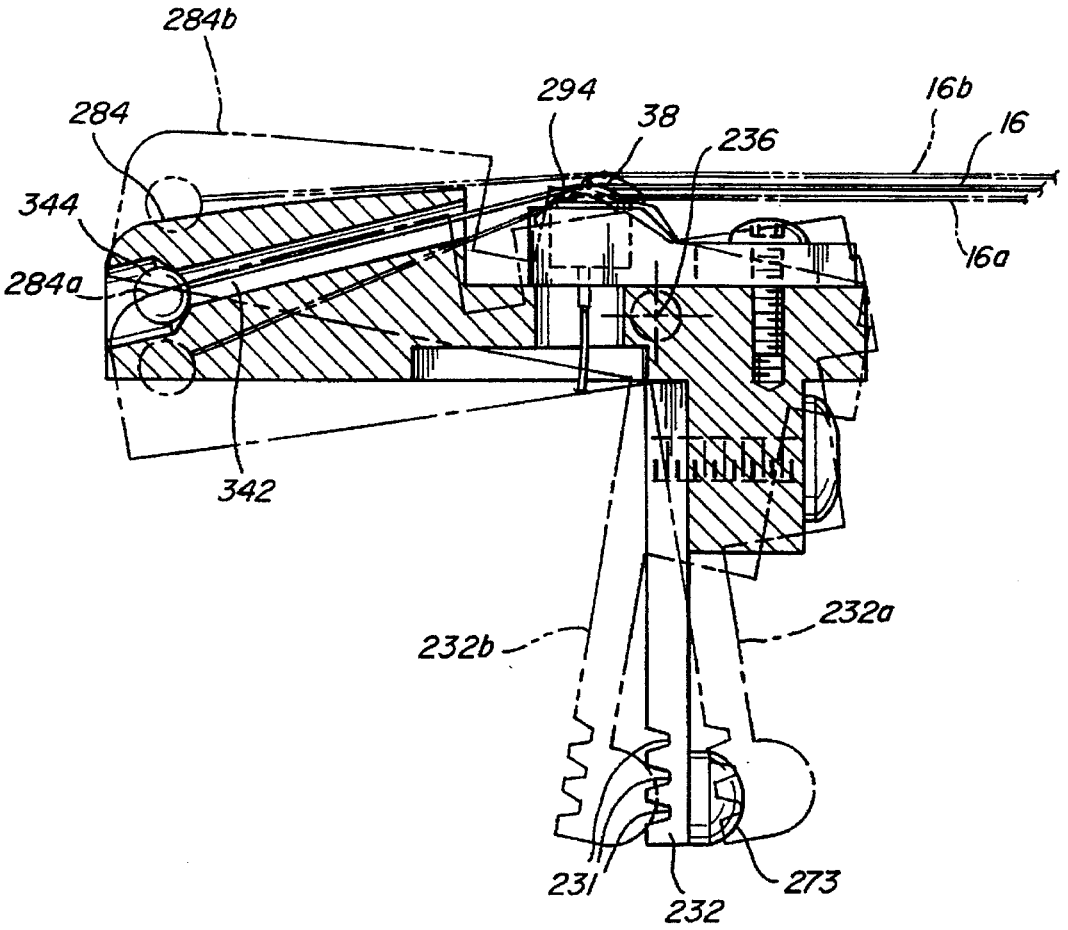
FIG. 44 is a schematic cross-sectional view taken along section lines 44—44 of FIG. 41.

Referring to FIG. 44, string 16 passes over cap 38 of pickup 340 and extends through an opening 342 where it is coupled to a ball 344. The diameter of the ball is greater than the diameter of the opening, so the ball is held in place against the opening. Thus, the string is not adjustable at this end, but rather is adjusted with pegs 18 (FIG. 1) on the headstock.

When the bar is raised away from the body of the guitar (counterclockwise), the rear portion 284 of the bridge moves to a new position **284*a* and the block moves to position 232*a*. This movement increases the tension on string 16*a*, thus raising the pitch of the string. This movement is effectively the situation that occurs when a player rests a hand on the bridge while playing. Similarly, when the bar is lowered toward the body (clockwise), the rear portion of the bridge moves to position 284*b*, the block moves to position 232*b*, and string 16*b* has less tension and thus lower pitch. This situation also occurs when the player bends strings. After the player rests a hand on the bridge, bends strings, or uses the bar, the bridge returns to its neutral position (in solid line) because of the counteracting forces of the tension of the strings that tends to pull ball 344 and rotate the rear portion to position 284*b* and the compression of the spring that tends to move the block to position 232*a***.

Figure 47:
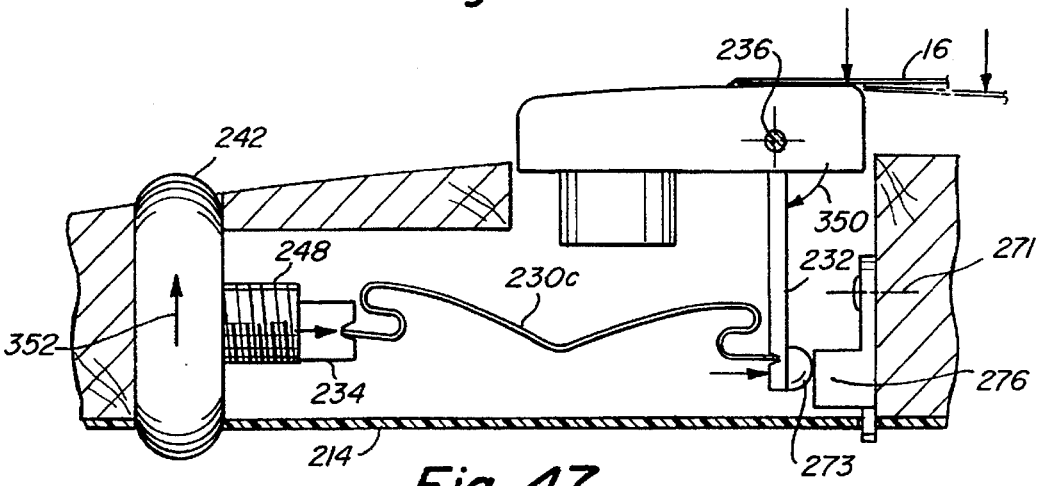

The operation of the guitar and the methods for moving between modes are described in connection with FIGS. 44–47. Referring generally to FIGS. 45–47, the vibrato according to the present invention allows for three distinct playing modes. Within each of these modes, further adjustment can be made on the fly while playing, and other adjustments can also be made through accessible controls.

Figure 45:
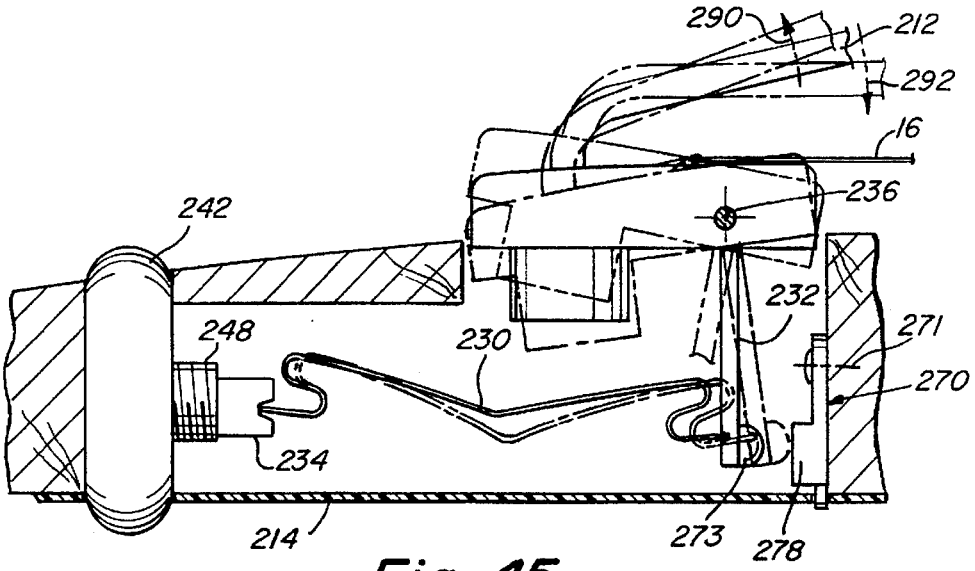
FIGS. 45–47 are schematic views of a vibrato according to the present invention in three modes of operation.

Referring to FIG. 45, in the floating mode, wheel 242 is set so that the compression on spring 230 is not particularly high, and lower step 278 of step stop 270 faces spring block 232. The player can thus operate the vibrato either by raising or by lowering the bar, (arrows 290 and 292, respectively). The bridge is in the floating mode in that it can be rotatably moved about axis 236 in either direction from the neutral position (in solid line).

Referring generally to FIG. 46, when upper step 276 is positioned to face the support block, the bar cannot be lifted and the rear of the bridge cannot be pushed downward because the step stop blocks movement of block 232. The user can still operate the vibrato in this mode by pushing the bar downward toward the body (arrow 292). If the user rests a hand on the bridge, it does not cause the bridge to move downward.

Referring to FIG. 47, the bridge can effectively be put in a fixed bridge mode if the upper step 276 abuts block 232, the wheel 242 is adjusted (arrow 352) so that the spring is compressed to position **230*c* to increase the compression force as indicated, and the bar 212 is removed from the bushing. While the bridge is not literally fixed in that it is physically possible to rotate it (arrow 350), the compression force of the spring in position 230*c*** substantially reduces movement in the bridge that can otherwise be caused by string bending. As in the classic mode, the bridge is also not moved if a player rests his/her hand on the bridge.

The vibrato according to the present invention has a number of features that provide a player great flexibility. The vibrato allows the player many options for adjustment so that it adapts to his/her individual style. Having described a preferred embodiment of the present invention, it should be apparent that other modifications and alterations can be made without departing from the scope of the appended claims. For example, while the bar is described as hexagonal in cross section, it could have some other non-circular polygonal cross-section.

What is claimed is:

1. A guitar comprising:

a body;

a neck extending away from the body;

a peghead at an end of the neck;

a movable bridge coupled to the body, the bridge including a spring block extending into the body perpendicular to the bridge;

a plurality of strings each having one end coupled to the peghead and another end coupled at the bridge;

a support member mounted in the body and positioned so that the bridge is intermediate the neck and the support member; and a flat compression spring coupled between the support member and the spring block.

2. The guitar of claim 1, wherein the compression spring has S-shaped portions at each end.

3. The guitar of claim 1, further comprising a linearly movable rod coupled to provide linear movement to the support member so that a compression force of the spring on the spring block is altered by movement of the rod.

4. The guitar of claim 3, wherein the rod is threaded, the guitar further including a manually rotatable wheel having an inner threaded bushing threaded over the rod for moving the rod toward and away from the bridge.

5. The guitar of claim 4, wherein the wheel is mounted so that it rotates in a plane generally perpendicular to the plurality of strings, the wheel being mounted at a portion of the body where the diameter of the wheel exceeds the thickness of the body so that a portion of the wheel extends out of the body.

6. The guitar of claim 1, further comprising a magnetic pickup adjacent the bridge so that the magnetic pickup is intermediate the bridge and the neck.

7. The guitar of claim 1, wherein the spring abuts the spring block without being rigidly connected to the spring block.

8. The guitar of claim 1, further including a movable stop movably mounted in the body to move into a position in which the movable stop abuts the spring block opposite the spring so that movement of the spring block away from said support member is stopped.

9. The guitar of claim 1, further including mounting posts coupled to the bridge on opposite sides of the bridge, the mounting posts being linearly movable along a thickness of the body.

10. The guitar of claim 9, further including threaded bolts extending into each said mounting post, the bolts being mounted in the body for rotatable non-linear movement so that rotating the bolts causes the mounting posts to move linearly.

11. A vibrato for a stringed musical instrument having a body, the vibrato comprising:

a bridge rotatably mounted in the body and having a neutral position from which movement is possible in two directions, the bridge including a spring block extending perpendicularly into the body; and limiting means, mounted in the body, for selectively contacting and limiting the spring block so that the bridge is operable in a first mode in which the bridge is movable in both directions and in a second mode in which the bridge is stopped from moving in a first direction from the neutral position while not stopped from moving in a second direction opposite to the first direction from the neutral position.

12. The vibrato of claim 11, wherein the limiting means includes a manually movable stop member that is movable from a first position in which the stop member abuts a side of the spring block to a second position in which the stop member is spaced from the side of the spring block.

13. The vibrato of claim 11, further comprising a spring attached to the spring block; and means for manually altering a force exerted by the spring on the spring block.

14. The vibrato of claim 11, wherein the limiting means includes a manually movable member that extends though the body and is manually actuable while the instrument is being played.

15. A guitar comprising:

a body;

a neck extending away from the body;

a peghead at an end of the neck;

a rotatably movable bridge coupled to the body, the bridge having a neutral position and being movable in first and second opposite directions from the neutral position, the bridge including a spring block extending perpendicularly into the body;

a plurality of strings each having one end coupled to the peghead and another end coupled at the bridge;

a support member mounted in the body and positioned so that the bridge is intermediate the neck and the support member;

a compression spring coupled between the support member and the spring block; and a stop member, movably mounted in the body, to move between a first position abutting the spring block opposite the spring to prevent movement of the bridge in the first direction while allowing movement in the second direction and a second position spaced away from the spring block so that the bridge is movable in the first and the second directions.

16. The instrument of claim 15, further comprising a bushing and a bar extending into the bushing for moving the bridge, wherein the bar has a hexagonal cross-section.

* * * * *